US008373737B2

(12) United States Patent
Kubota

(10) Patent No.: US 8,373,737 B2
(45) Date of Patent: Feb. 12, 2013

(54) OPTICAL HEAD AND ELECTRONIC DEVICE

(75) Inventor: Takehiko Kubota, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 73 days.

(21) Appl. No.: 13/078,294

(22) Filed: Apr. 1, 2011

(65) Prior Publication Data

US 2011/0242264 A1 Oct. 6, 2011

(30) Foreign Application Priority Data

Apr. 5, 2010 (JP) ..... 2010-086760

(51) Int. Cl.
*B41J 2/45* (2006.01)
*B41J 15/14* (2006.01)
*B41J 27/00* (2006.01)

(52) U.S. Cl. ..... 347/244; 347/238; 347/258

(58) Field of Classification Search ..... 347/230, 347/238, 241, 242, 244, 256–258
See application file for complete search history.

(56) References Cited

U.S. PATENT DOCUMENTS

| | | | | |
|---|---|---|---|---|
| 5,543,830 | A * | 8/1996 | Lea | 347/241 |
| 5,835,119 | A * | 11/1998 | Samuels | 347/238 |
| 6,816,181 | B2 * | 11/2004 | Ohkubo | 347/238 |
| 7,081,912 | B2 * | 7/2006 | Seki et al. | 347/244 |

FOREIGN PATENT DOCUMENTS

| | | |
|---|---|---|
| JP | A 2002-248803 | 9/2002 |
| JP | A 2008-093882 | 4/2008 |
| JP | A 2008-155458 | 7/2008 |

* cited by examiner

*Primary Examiner* — Hai C Pham
(74) *Attorney, Agent, or Firm* — Oliff & Berridge, PLC

(57) ABSTRACT

A light emitting substrate has a plurality of first light emitting portions arranged in a main scanning direction and a second light emitting portion disposed in a direction intersecting the main scanning direction with respect to the array of the plurality of first light emitting portions. A lens array has a plurality of first lenses, each of which is disposed to face each of the plurality of first light emitting portions, and a second lens for the second light emitting portion. A direction of the emitted light from the second light emitting portion has a slope with respect to a straight line which extends perpendicularly from a light emitting face of the corresponding second light emitting portion.

14 Claims, 17 Drawing Sheets

OPTICAL HEAD AND ELECTRONIC DEVICE

BACKGROUND

1. Technical Field

The present invention relates an optical head having a plurality of light emitting portions and an electronic device.

2. Related Art

Image forming apparatuses such as a printer have an optical head for exposing an image carrier (for example, a photoconductor drum) and for writing a latent image thereon. Such a kind of optical head has a light emitting element array in which many light emitting elements are arranged in the main scanning direction. Further, the light emitting element array is configured such that a plurality of light emitting element chips, in which a predetermined number of light emitting elements is arranged, are lined up in the main scanning direction.

However, when a plurality of light emitting element chips are lined up in a line in the main scanning direction, in order to keep the light emission pitch constant even at the boundary portion between the neighboring light emitting element chips, it is necessary to set the distance from the endmost light emitting element to the chip end portion to a half or less of the light emission pitch in each light emitting element. However, when the distance from the endmost light emitting element to the chip end portion is set to be equal to or less than a half of the light emission pitch, if the light emission pitch is set to be small in order to increase the resolution thereof, a problem arises in that the endmost light emitting element may be dropped out when the light emitting element chips are cut, or the like. Hence, there is provided a technique for arranging the plurality of light emitting element chips in a staggered manner in the main scanning direction (for example, refer to JP-A-2002-248803 and JP-A-2008-155458).

However, when the plurality of light emitting element chips are arranged in a staggered manner in the main scanning direction, the width of the optical head in the sub-scanning direction increases.

SUMMARY

An advantage of some aspects of the invention is to provide an optical head in which the light emitting substrates can be lined up in a line in the main scanning direction even when the distance from the endmost light emitting portion to the substrate end portion is not set to be equal to or less than a half of the light emission pitch, and an electronic device using the optical head.

In order to solve the above problems, according to a first aspect of the invention, there is provided an optical head including: a light emitting substrate that has a plurality of first light emitting portions arranged in a main scanning direction and a second light emitting portion disposed in a direction intersecting the main scanning direction with respect to the array of the plurality of first light emitting portions; and a lens array that has a plurality of first lenses, each of which is provided at a position facing each of the plurality of first light emitting portions and forms an image of light emitted from each first light emitting portion on an illumination target surface, and a second lens which forms an image of light emitted from the second light emitting portion on the illumination target surface. The image of the light, which is emitted from each of the plurality of first light emitting portions, is formed at a position where the illumination target surface intersects with a straight line which connects each corresponding first light emitting portion to each first lens facing thereto. A direction of the emitted light from the second light emitting portion has a slope with respect to a straight line which extends perpendicularly from a light emitting face of the corresponding second light emitting portion. When an imaging position of the light emitted from the first light emitting portion located at one end among the plurality of first light emitting portions is set as a first imaging position and an imaging position of the light emitted from another first light emitting portion is set as a second imaging position, the image of the light emitted from the second light emitting portion is formed on a side opposite to a side of the second imaging position with the first imaging position interposed therebetween.

With such a configuration, it is possible to form the image of the light, which is emitted from the second light emitting portion, on the outer side from the imaging positions of the light which is emitted from the two first light emitting portions positioned at both ends among the plurality of first light emitting portions arranged on the light emitting substrate. That is, the image of the emitted light from the second light emitting portion is formed on the illumination target surface, on the outer side from the positions corresponding to both ends of the plurality of first light emitting portions which are arranged on the light emitting substrate. Accordingly, although the distance from the endmost light emitting portion to the substrate end portion (hereinafter, referred to as a distance of a frame portion) is not set to a half of the light emission pitch in the same manner as the related art, it is possible to line up the plurality of light emitting substrates in a line in the main scanning direction. Hence, by decreasing the width of the optical head in the sub-scanning direction, it is possible to miniaturize the optical head.

Further, according to the aspect of the invention, the distance of the frame portion, by which the light emitting substrates can be lined up in a line, can be set to be larger than that of the related art. Therefore, the accuracy necessary for cutting the light emitting substrates may not be high as compared with that of the related art. Hence, it becomes easy to cut out the light emitting substrate.

Further, in the optical head according to the first aspect mentioned above, it is preferable that the second light emitting portion should have a light emitting layer that emits light and a light reflecting layer that reflects the light which is emitted by the light emitting layer. In addition, it is also preferable that the light reflecting layer should be formed such that a direction of the reflected light has the slope.

In this case, it is possible to set the direction of the emitted light from the second light emitting portion depending on the direction of the reflected light from the light reflecting layer. Hence, it is easy to manufacture the light emitting substrate.

Further, in the optical head according to the first aspect mentioned above, it is preferable that the light reflecting layer should be disposed at a predetermined angle to the light emitting layer such that the direction of the reflected light has the slope. Further, in the optical head according to the first aspect mentioned above, it is preferable that the light reflecting layer should have a prescribed shape such that the direction of the reflected light has the slope.

In this case, the direction of the emitted light from the second light emitting portion can be set depending on the shape of the light reflecting layer or the angle of the disposed light reflecting layer to the light emitting layer. Hence, it is easy to manufacture the light emitting substrate.

Further, in the optical head according to the first aspect mentioned above, it is preferable that the plurality of first light emitting portions should be arranged at a predetermined pitch in the main scanning direction. It is also preferable that the image of the light emitted from the second light emitting portion should be formed at a position which is separated by the predetermined pitch in a direction opposite to the side of the second imaging position from the first imaging position.

In this case, it is possible to maintain the imaging positions of the emitted light from the respective first light emitting portions at equal intervals (the predetermined pitch). Besides, it is possible to maintain, at the predetermined pitch, the space between the imaging position of the emitted light from the second light emitting portion and the imaging position of the emitted light from the first light emitting portion located at one end among the plurality of first light emitting portions.

Further, in the optical head according to the first aspect mentioned above, it is preferable that the number of the second light emitting portions, which are provided in the light emitting substrate, should be two. It is also preferable that the number of the second lenses, which are provided in the lens array so as to form the images of the light emitted from the corresponding second light emitting portions, should be two. It is also preferable that the direction of the emitted light from each of the two second light emitting portions should have a slope with respect to the straight line which extends perpendicularly from the light emitting face of the corresponding second light emitting portion. It is also preferable that the image of the light emitted from one of the second light emitting portions should be formed on the side opposite to the side of the second imaging position with the first imaging position interposed therebetween. It is also preferable that, when an imaging position of the light emitted from the first light emitting portion located at the other end among the plurality of first light emitting portions is set as a third imaging position and an imaging position of the light emitted from another first light emitting portion is set as a fourth imaging position, the image should be formed on a side opposite to a side of the fourth imaging position with the third imaging position interposed therebetween.

With such a configuration, it is possible to form the images of the light, which is emitted from the two second light emitting portions, on the outer side such that the imaging positions of the light, which is emitted from the two first light emitting portions positioned at both ends among the plurality of first light emitting portions arranged on the light emitting substrate, are interposed between both sides. In this case, the distance of the frame portion, by which the light emitting substrates can be lined up in a line, can be set to be larger than that of the configuration in which one second light emitting portion and one second lens are provided.

Further, according to a second aspect of the invention, there is provided an optical head including: a light emitting substrate that has a plurality of first light emitting portions arranged in a main scanning direction and a second light emitting portion disposed in a direction intersecting the main scanning direction with respect to the array of the plurality of first light emitting portions; and a lens array that has a plurality of first lenses, each of which is provided at a position facing each of the plurality of first light emitting portions and forms an image of light emitted from each first light emitting portion on an illumination target surface, and a second lens which forms an image of light emitted from the second light emitting portion on the illumination target surface. A direction of the emitted light from each of the plurality of first light emitting portions coincides with a straight line which extends perpendicularly from a light emitting face of the corresponding first light emitting portion. A direction of the emitted light from the second light emitting portion has a slope with respect to a straight line which extends perpendicularly from a light emitting face of the corresponding second light emitting portion.

With such a configuration, the direction of the emitted light from the second light emitting portion is tilted with respect to the straight line which extends perpendicularly from the light emitting face of the corresponding second light emitting portion. Thereby, it is possible to form the image of the light, which is emitted from the second light emitting portion, on the outer side from the imaging positions of the light, which is emitted from the two first light emitting portions located at both ends, among the plurality of first light emitting portions arranged on the light emitting substrate. Therefore, this configuration exhibits the same effect as that of the optical head according to the first aspect of the invention mentioned above.

Further, according to a third aspect of the invention, there is provided an optical head including: a light emitting substrate that has a plurality of light emitting portions arranged in a line in a main scanning direction; and a lens array that has a plurality of lenses which are arranged in a line in the main scanning direction and each of which forms an image of light emitted from each corresponding light emitting portion on an illumination target surface. When any light emitting portion among the plurality of light emitting portions is set as a first light emitting portion and the light emitting portion arranged near the corresponding first light emitting portion is set as a second light emitting portion, a direction of the emitted light from the first light emitting portion differs from a direction of the emitted light from the second light emitting portion such that a distance between an imaging position of the light, which is emitted from the first light emitting portion, and an imaging position of the light, which is emitted from the second light emitting portion, is larger than an array space between the first light emitting portion and the second light emitting portion.

With such a configuration, the space between the imaging positions of the light emitted from the respective light emitting portions is set to be larger than the array space between the light emitting portions. Accordingly, the image of the emitted light from at least one light emitting portion, which is positioned at one end, among the plurality of light emitting portions is formed on the illumination target surface, on the outer side from the positions corresponding to both ends of the plurality of light emitting portions which are arranged on the light emitting substrate. Thus, this configuration exhibits the same effect as that of the optical head according to the first aspect of the invention mentioned above.

Further, in the optical head according to the third aspect mentioned above, it is preferable that each of the plurality of light emitting portions should have a light emitting layer that emits light, and a light reflecting layer that reflects the light which is emitted by the light emitting layer. It is also preferable that the direction of the light reflected by the first light emitting portion should differ from the direction of the light reflected by the second light emitting portion such that the distance between the imaging position of the light, which is emitted from the first light emitting portion, and the imaging position of the light, which is emitted from the second light emitting portion, is larger than the array space between the first light emitting portion and the second light emitting portion.

In this case, in each light emitting portion, it suffices only to change the direction of the reflected light from the light reflecting layer. Hence, it is easy to manufacture the light emitting substrate.

Further, in the optical head according to the third aspect mentioned above, it is preferable that the light reflecting layer of the first light emitting portion and the light reflecting layer of the second light emitting portion should be disposed at different angles to the light emitting layers. In addition, in the optical head according to the third aspect mentioned above, it is also preferable that the light reflecting layer of the first light emitting portion and the light reflecting layer of the second light emitting portion should have different shapes.

In this case, in each light emitting portion, it suffices only to change the shape of the light reflecting layer or the angle of the angle of the disposed light reflecting layer to the light emitting layer. Hence, it is easy to manufacture the light emitting substrate.

Further, according to a fourth aspect of the invention, there is provided an optical head including: a light emitting substrate that has a plurality of light emitting portions arranged in a line in a main scanning direction; and a lens array that has a plurality of lenses which are arranged in a line in the main scanning direction and each of which forms an image of light emitted from each corresponding light emitting portion on an illumination target surface. A direction of the emitted light from each of the plurality of light emitting portions has a larger slope from a center of an array of the light emitting portions toward an end thereof with respect to a straight line, which extends perpendicularly from a light emitting face of the corresponding light emitting portion, as an array position of the corresponding light emitting portion becomes closer to the end of the array than the center thereof.

With such a configuration, the images of the emitted light from at least two light emitting portions, which are positioned at both ends, among the plurality of light emitting portions are formed on the illumination target surface, on the outer side from the positions corresponding to both ends of the plurality of light emitting portions which are arranged on the light emitting substrate. Accordingly, this configuration exhibits the same effect as that of the optical head according to the first aspect of the invention mentioned above. Further, the distance of the frame portion, by which the light emitting substrates can be lined up in a line, can be set to be larger than that of the configuration of the above-mentioned optical head according to the first aspect in which one second light emitting portion and one second lens are provided.

Further, in the optical head according to the third or fourth aspect mentioned above, it is preferable that the plurality of light emitting portions should be arranged at a first pitch in the main scanning direction. It is also preferable that the images of the light emitted from the plurality of respective light emitting portions should be formed in a line in the main scanning direction at a second pitch which is larger than the first pitch.

In this case, at is possible to maintain the imaging positions of the emitted light from the respective light emitting portions at equal intervals (the second pitch).

Further, in the optical head according to any aspect mentioned above, it is preferable that a plurality of the light emitting substrates and a plurality of the lens arrays should be provided. It is also preferable that the plurality of the light emitting substrates and the plurality of the lens arrays should be arranged in the main scanning direction.

Further, the above-mentioned optical heads according to the aspects are used in various electronic devices. A typical example of the electronic devices according to the aspects of the invention is an image forming apparatus. The image forming apparatus includes the optical head according to any aspect mentioned above, an image carrier (for example, a photoconductor drum) on which the latent image is formed through exposure of the optical head, and a developing unit which performs development by applying a developer (for example, a toner) to the latent image of the image carrier.

First of all, the application of the optical head according to the aspect of the invention is not limited to the exposure of the image carrier. For example, in image readout apparatuses such as a scanner, the optical head according to the aspect of the invention can be used to illuminate an original document. The image readout apparatus includes the optical head according to any aspect mentioned above and a light receiving unit (for example, a light receiving element such as a CCD (Charge Coupled Device) element) that converts light, which is emitted from the optical head and is reflected by the readout target (the original document), into an electric signal.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
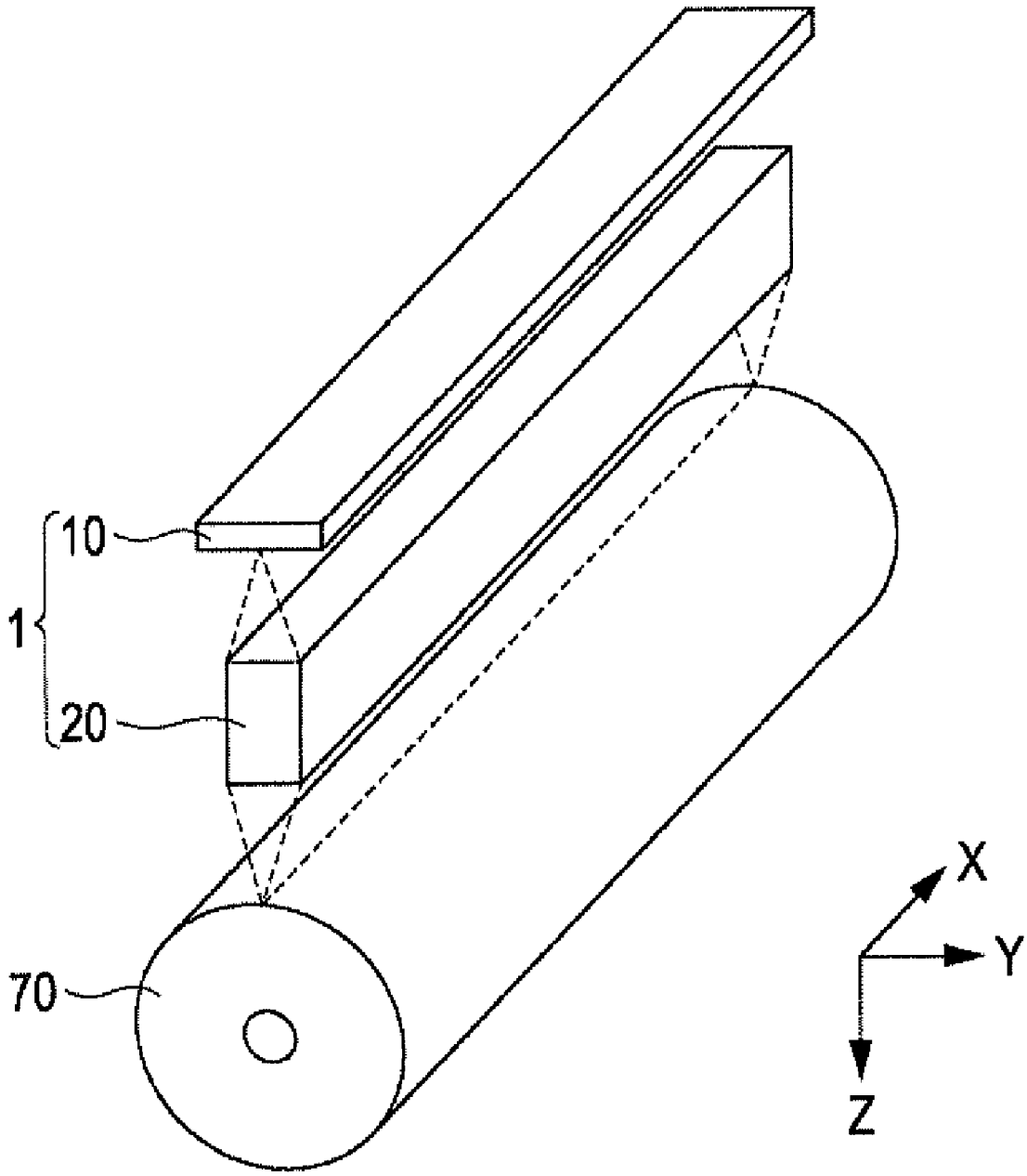
FIG. 1 is a perspective view illustrating a partial structure of an image forming apparatus.

Hereinafter, embodiments of the invention will be described with reference to the accompanying drawings. It should be noted that, in the drawings, dimensions of the respective elements may not exactly reflect those in an actual situation.

A. First Embodiment

FIG. 1 is a perspective view illustrating a partial structure of an image forming apparatus.

As shown in the drawing, the image forming apparatus includes a photoconductor drum 70 and an optical head 1 that records a latent image by exposing the outer circumferential surface of the photoconductor drum 70. Further, the optical head 1 includes a light emission panel 10, in which a plurality of light emitting elements are arranged, and a lens array 20 which is disposed between the light emission panel 10 and the photoconductor drum 70. The photoconductor drum 70 is supported by a rotation shaft extending in the X direction (the main scanning direction) so as to thereby rotate in a state where the outer circumferential surface is made to face the optical head 1. Further, an image of light originating from the light emission panel 10 (the respective light emitting elements) is formed on the surface of the photoconductor drum 70 through the lens array 20.

Figure 2:
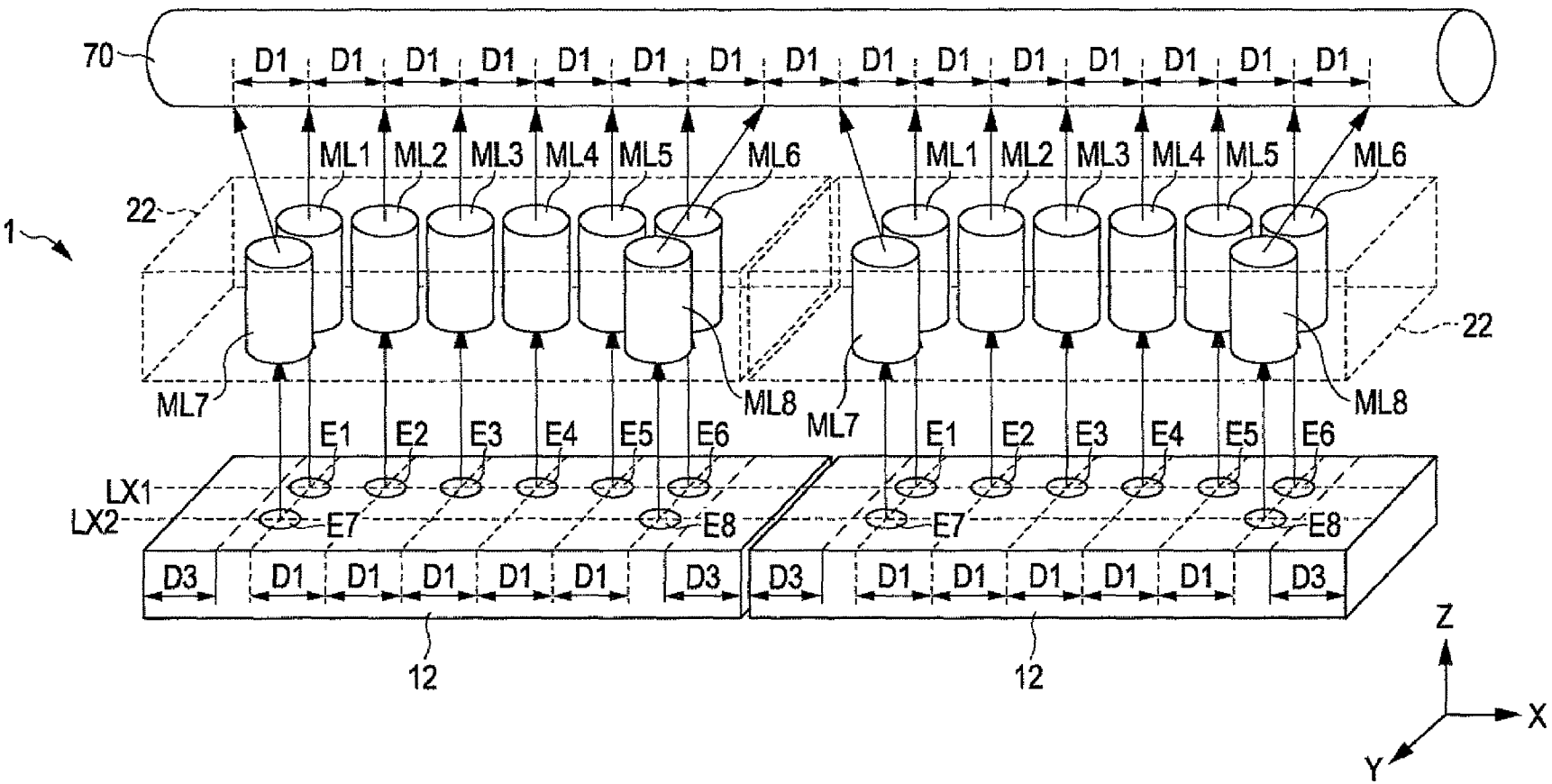
FIG. 2 is a perspective view illustrating a structure of an optical head according to a first embodiment.

FIG. 2 is a perspective view illustrating a structure of the optical head 1 according to the first embodiment.

In addition, in FIGS. 1 and 2, in the positional relationship between the optical head 1 and the photoconductor drum 70, those are reversed to each other in the up-and-down direction (the Z direction). Two light emitting element chips 12 are arranged in a line in the X direction on the surface of the photoconductor drum 70 in the light emission panel 10 shown in FIG. 1. In addition, in FIG. 2, for convenience of description, the two light emitting element chips 12 are shown as an example, but three light emitting element chips 12 may be arranged in a line.

In each light emitting element chip 12, eight light emitting elements E1 to E8, which have a circular light emitting face as a surface-emitting light source, are formed. The six light emitting elements E1 to E6 of them are arranged in a line at a pitch D1 along the X direction. Further, the remaining two light emitting elements E7 and E8 are provided at positions separated by a predetermined distance from the light emitting elements E1 and E6 in the Y direction (the sub-scanning direction). Specifically, in each light emitting element chip 12, the six light emitting elements E1 to E6 are arranged at a pitch D1 in a straight line LX1 which extends in the X direction, and the two light emitting elements E7 and E8 are arranged in a straight line LX2 which is parallel with the straight line LX1 with a predetermined space. As can be clearly seen from FIG. 2, it is preferable that the light emitting elements E7 and E8 should be disposed at positions where the elements E7 and E8 are respectively adjacent to the light emitting elements E1 and E6 as the end portions of the array of the light emitting elements E1 to E6. It should be noted that, in the embodiment, it is not necessary to provide a light emitting element between the light emitting elements E7 and E8 in the X direction. Further, in one light emitting element chip 12, the number of the light emitting elements arranged in the straight line LX1 is not limited to 6 and is preferably two or more. Furthermore, in the following description, if there is no need to particularly distinguish the respective light emitting elements, the light emitting elements are noted as light emitting elements E.

Each light emitting element E is, for example, an organic light-emitting diode (Organic Light Emitting Diode) element, and emits light by current supply. Further, although not shown in the drawings, each light emitting element E has a light emitting layer that is formed of an organic EL (Electro Luminescent) material and one electrode and another electrodes that are disposed with the light emitting layer interposed therebetween. Furthermore, each light emitting element E is covered by a sealing layer (not shown), in which the light originating from each light emitting element E is transmitted through the sealing layer and is emitted. For this reason, the sealing layer and the electrode on the sealing layer side are formed of a material with a high transmittance. Moreover, frame portions with the width D3 are provided at both ends of each light emitting element chip 12 in order to secure a tolerance margin at the time of cutting out the light emitting element chip 12. The light emitting element E may not be disposed on the frame portion.

Next, the lens array 20 shown in FIG. 1 includes two lens array units 22. Each lens array unit 22 is disposed to face the light emitting element chip 12, and has a tabular base formed of an optically transparent material (for example, glass) as indicated by the dotted line in FIG. 2. Further, eight circular lens portions are formed on each of the surface of the base close to the photoconductor drum 70 and the surface of the base close to the light emitting element chip 12, and two lens portions, which are opposed to each other with the base interposed therebetween, and the base, which is present between both of them, constitutes one micro lens (a biconvex lens). Furthermore, when three light emitting element chips 12 are arranged in a line, three lens array units 22 constitute the lens array 20.

In each lens array unit 22, a micro lens ML1 is provided at a position opposed to the light emitting element E1, a micro lens ML2 is provided a position opposed to the light emitting element E2, . . . , and a micro lens ML6 is provided at a position opposed to the light emitting element E6. Further, a micro lens ML7 is provided at a position opposed to the light emitting element E7, and a micro lens ML8 is provided at a position opposed to the light emitting element E8. As described above, among the eight micro lenses ML1 to ML8 provided in each lens array unit 22, the six micro lenses ML1 to ML6 are arranged in a line at the pitch D1 along the X direction, and the remaining two micro lenses ML7 and ML8 are provided at positions separated by a predetermined distance from the micro lenses ML1 and ML6 in the Y direction. Furthermore, in the following description, if there is no need to particularly distinguish the respective micro lenses, the micro lenses are noted as micro lenses ML.

Further, although not shown in the drawings, a spacer for keeping the distance between the light emitting element chip 12 and the lens array unit 22 constant is disposed between the light emitting element chip 12 and the lens array unit 22. The spacer has eight through-holes that are formed to make the light, which is emitted from each light emitting element E, incident to each micro lens ML opposed thereto. Further, the spacer is formed of a material having a light blocking effect. Thus, the spacer prevents the light, which originates from the light emitting element E, from being incident to the micro lenses ML which are not opposed to the light emitting element E.

Each micro lens ML forms the image of the emitted light from the light emitting element E opposed thereto on the surface of the photoconductor drum 70. Further, the micro lenses ML1 to ML6 are lenses of which the optical centers and the geometric centers coincide with each other, and are disposed such that the respective center axes are directed to the Z direction. Further, the micro lenses ML7 and ML8 are lenses (a so-called eccentric lens) of which the optical centers and the geometric centers are different from each other. Furthermore, the number of the micro lenses ML provided in one lens array unit 22 is not limited to 8. For example, in a case where 128 light emitting elements E are provided in one light emitting element chip 12, 128 micro lenses ML are provided in one lens array unit 22.

Figure 3:
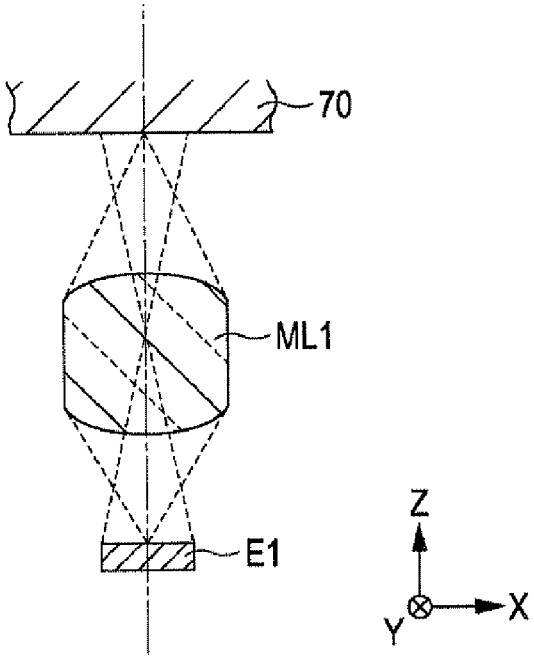
FIG. 3 is a sectional view illustrating an arrangement relationship between a light emitting element and a micro lens.

FIG. 3 is a sectional view illustrating an arrangement relationship between the light emitting element E1 and the micro lens ML1.

The micro lens ML1 is a lens of which the optical center and the geometric center coincide with each other. Further, as shown in the drawing, the light emitting element E1 and the micro lens ML1 are opposed to each other such that the light emission center of the light emitting element E1 coincides with the optical axis of the micro lens ML1. Furthermore, the optical axis of the micro lens ML1 is a straight line that connects the centers of the two lens portions constituting the micro lens ML1. Further, the micro lens ML1 as an example is a gradient index lens having a cylindrical shape. In the cross section thereof, the refractive index may be low at the center axis (the optical axis), and the refractive index may be higher at the position farther from the center axis. Through the micro lens ML1, the light, which is emitted from the light emitting element E1 and incident to the lower-side lens portion in the drawing, exits from the upper-side lens portion in the drawing. Further, the image of the emitted light from the light emitting element E1 is formed at the position where the optical axis of the micro lens ML1 intersects with the surface of the photoconductor drum 70. More specifically, a spot area, where the image of the emitted light from the light emitting element E1 is formed, is formed. The spot area is centered on the position intersecting the optical axis of the micro lens ML1 on the surface of the photoconductor drum 70.

Furthermore, the light emitting element E2 and the micro lens ML2, the light emitting element E3 and the micro lens ML3, . . . , and the light emitting element E6 and the micro lens ML6 have the same arrangement relationship as the light emitting element E1 and the micro lens ML1. Accordingly, the images of the light, which is emitted from the light emitting elements E1 to E6, are formed on the surface of the photoconductor drum 70 in a line at the pitch D1 along the X direction.

Figure 4:
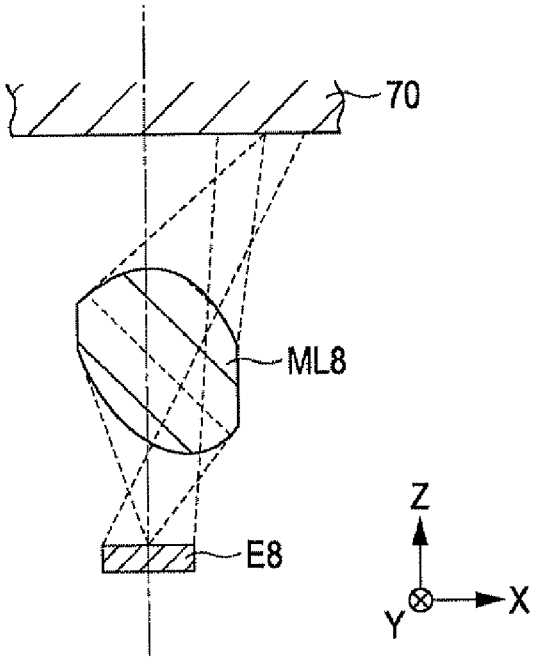
FIG. 4 is a sectional view illustrating an arrangement relationship between a light emitting element and a micro lens.

FIG. 4 is a sectional view illustrating an arrangement relationship between the light emitting element E8 and the micro lens ML8.

The micro lens ML8 is an eccentric lens, and is able to refract the traveling direction of the light, which is emitted from the light emitting element E8, in the X direction. Hence, as shown in FIG. 2, the micro lens ML8 is able to form the image of the light, which is emitted from the light emitting element E8, on the X-direction side from the imaging position of the light, which is emitted from the light emitting element E6. Further, a degree of eccentricity of the micro lens ML8 is set such that the image of the light, which is emitted from the light emitting element E8, can be formed on the X-direction side from the imaging position of the light, which is emitted from the light emitting element E6, by the pitch D1. As described above, the micro lens ML8 has a function of refracting the light, which is emitted from the light emitting element E8, to at least the X direction. Accordingly, as far as the micro lens ML8 has a function of making the light, which is emitted from the light emitting element E8, travel in a direction different from the original emission direction thereof, it is possible to obtain a desirable result based on the embodiment of the invention.

Furthermore, the arrangement relationship between the light emitting element E7 and the micro lens ML7 is the same as the arrangement relationship between the light emitting element E8 and the micro lens ML8 reversed in the X direction. Accordingly, as shown in FIG. 2, the micro lens ML7 is able to form the light, which is emitted from the light emitting element E7, on the side opposite to the X direction from the imaging position of the light which is emitted from the light emitting element E1. Further, a degree of eccentricity of the micro lens ML7 is set such that the image of the light, which is emitted from the light emitting element E7, can be formed on the side opposite to the X direction from the imaging position of the light, which is emitted from the light emitting element E1, by the pitch D1.

Furthermore, the micro lens ML8 (ML7) according to the embodiment deflects the light, which is emitted from the light emitting element E8 (E7) opposed thereto, in the X direction (in the direction opposite to the X direction). Further, in FIG. 2, the light emitting element chip 12 and the lens array unit 22 on the left side of the drawing and the light emitting element chip 12 and the lens array unit 22 on the right side of the drawing are disposed such that the pitch D1 is equal to the space between the imaging position of the light, which is emitted from the light emitting element E8 of the light emitting element chip 12 on the left side of the drawing, and the imaging position of the light which is emitted from the light emitting element E7 of the light emitting element chip 12 on the right side of the drawing.

The optical head 1 includes a driving circuit (not shown) that controls the magnitude of current, which is supplied to each light emitting element E, and the light emission timing of each light emitting element E. The driving circuit controls the magnitude of the current, which is supplied to each light emitting element E, in accordance with the image printed on a printing medium such as a paper. Further, the driving circuit controls the light emission timing of each light emitting element E such that the latent image is formed on the surface of the photoconductor drum 70. The latent image corresponds to a single line of the image which is formed by the light emitted from all the light emitting elements E provided in the light emission panel 10.

Here, it is assumed that the space between the straight line LX1 and the straight line LX2 shown in FIG. 2 is ΔD. When all the light emitting elements E1 to E6 in the straight line LX1 are made to emit light, after the time necessary for advancing the surface of the photoconductor drum 70 by the distance ΔD in the Y direction has elapsed, all the light emitting elements E7 and E8 in the straight line LX2 are made to emit light. Thereby, on the outer circumferential surface of the photoconductor drum 70, the image of the emitted light from the light emitting element E7 is formed at the position which is separated by the pitch D1 from the imaging position of the emitted light from the light emitting element E1 in the direction opposite to the X direction. Further, the image of the emitted light from the light emitting element E8 is formed at the position which is separated by the pitch D1 in the X direction from the imaging position of the emitted light from the light emitting element E6. Accordingly, on the outer circumferential surface of the photoconductor drum 70, the images of the light, which is emitted from all the light emitting elements E provided in the light emission panel 10, are formed in a line at the pitch D1 in the X direction, thereby forming a single line of the latent image. Further, by repeating the same operation in parallel with the rotation of the photoconductor drum 70, the latent image is formed of a plurality of lines on the outer circumferential surface of the photoconductor drum 70.

As described above, according to the embodiment, it is possible to form the images of the light, which is emitted from the light emitting elements E7 and E8, on the outer sides from the imaging positions of the light, which is emitted from the light emitting elements E1 and E6 positioned at both ends among the light emitting elements E1 to E6 arranged in the light emitting element chip 12, with the pitch D1 maintained. That is, it is possible to form the images of the light, which is emitted from the light emitting elements E7 and E8, on a part of the surface of the photoconductor drum 70 corresponding to the frame portion of the light emitting element chip 12. Accordingly, although the width D3 of the frame portion is not set to a half of the pitch D1 in the same manner as the related art, it is possible to line up the plurality of light emitting element chips 12 in a line in the X direction. For example, in the case of FIG. 2, it is possible to set the width D3 of the frame portion, by which the light emitting element chips 12 are lined up in a line, to maximum 1.5 times the pitch D1. Specifically, when the width D3 of the frame portion is equal to or less than 1.5 times the pitch D1, it is possible to line up the light emitting element chips 12 in a line in the X direction.

As described above, according to the embodiment, even when the width D3 of the frame portion is larger than a half of the pitch D1, if the width is equal to or less than 1.5 times the pitch D1, it is possible to line up the light emitting element chips 12 in a line in the X direction. Hence, it is possible to miniaturize the optical head 1 by decreasing the width of the optical head 1 in the Y direction. Further, according to the embodiment, the width D3 of the frame portion, by which the light emitting element chips 12 can be lined up in a line, can be set to be larger than that of the related art. Therefore, the accuracy necessary for cutting the light emitting element chips 12 may not be high as compared with that of the related art. Hence, it becomes easy to cut out the light emitting element chip 12.

B. Second Embodiment

Next, a second embodiment will be described. Further, in the embodiment, the elements common to the first embodiment will be represented by the same reference numerals and signs, and a detailed description thereof will be appropriately omitted.

Figure 5:
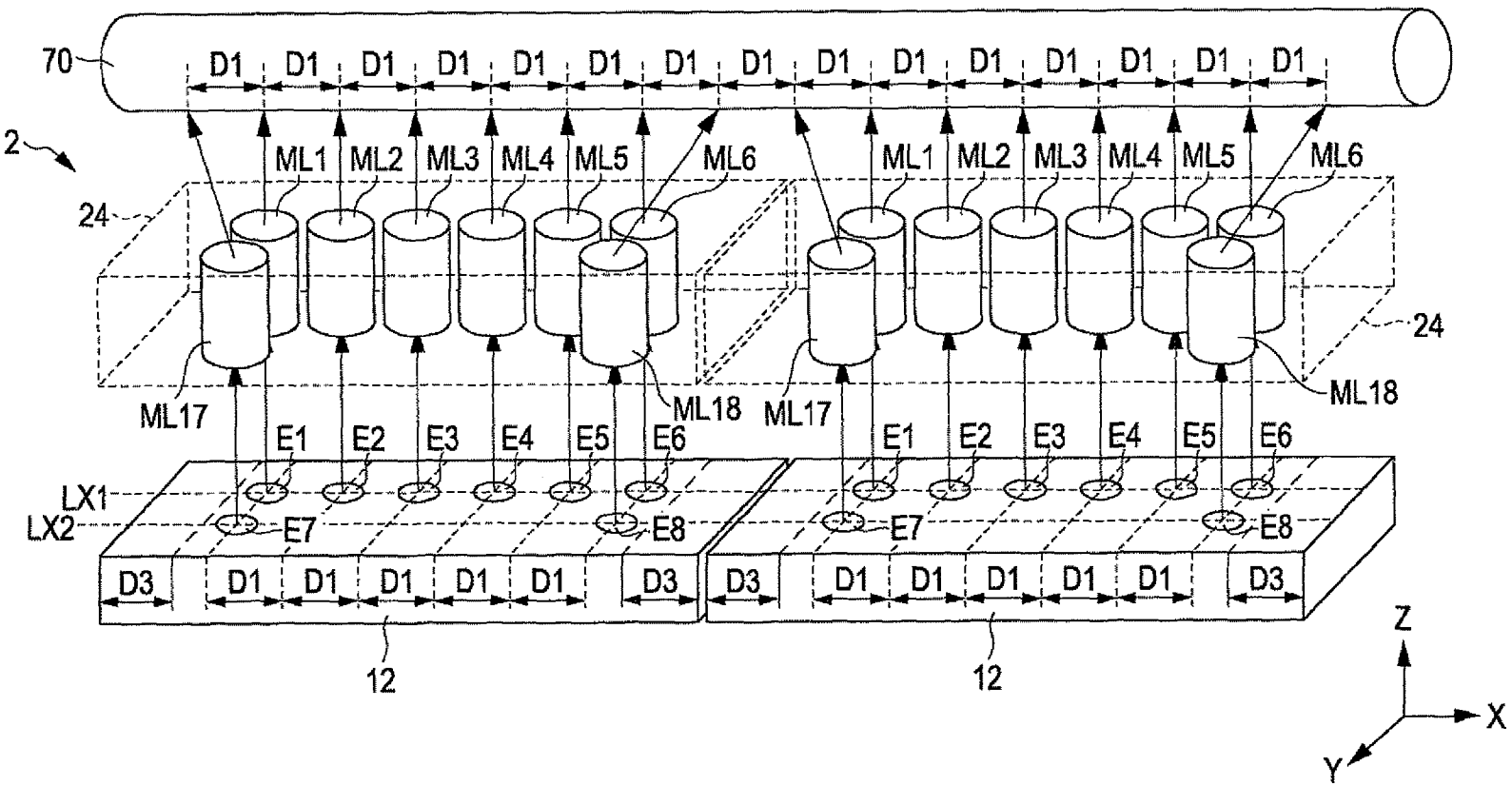
FIG. 5 is a perspective view illustrating a structure of an optical head according to a second embodiment.

FIG. 5 is a perspective view illustrating a structure of an optical head 2 according to the second embodiment.

The optical head 2 according to the embodiment is different from the optical head 1 of the first embodiment only in the micro lenses ML17 and ML18 provided in each lens array unit 24. In the first embodiment, the eccentric lens is used in the micro lenses ML7 and ML8 opposed to the light emitting elements E7 and E8. However, in the present embodiment, the lens of which the optical center and the geometric center coincide with each other is used in the micro lenses ML17 and ML18 opposed to the light emitting elements E7 and E8.

Figure 6:
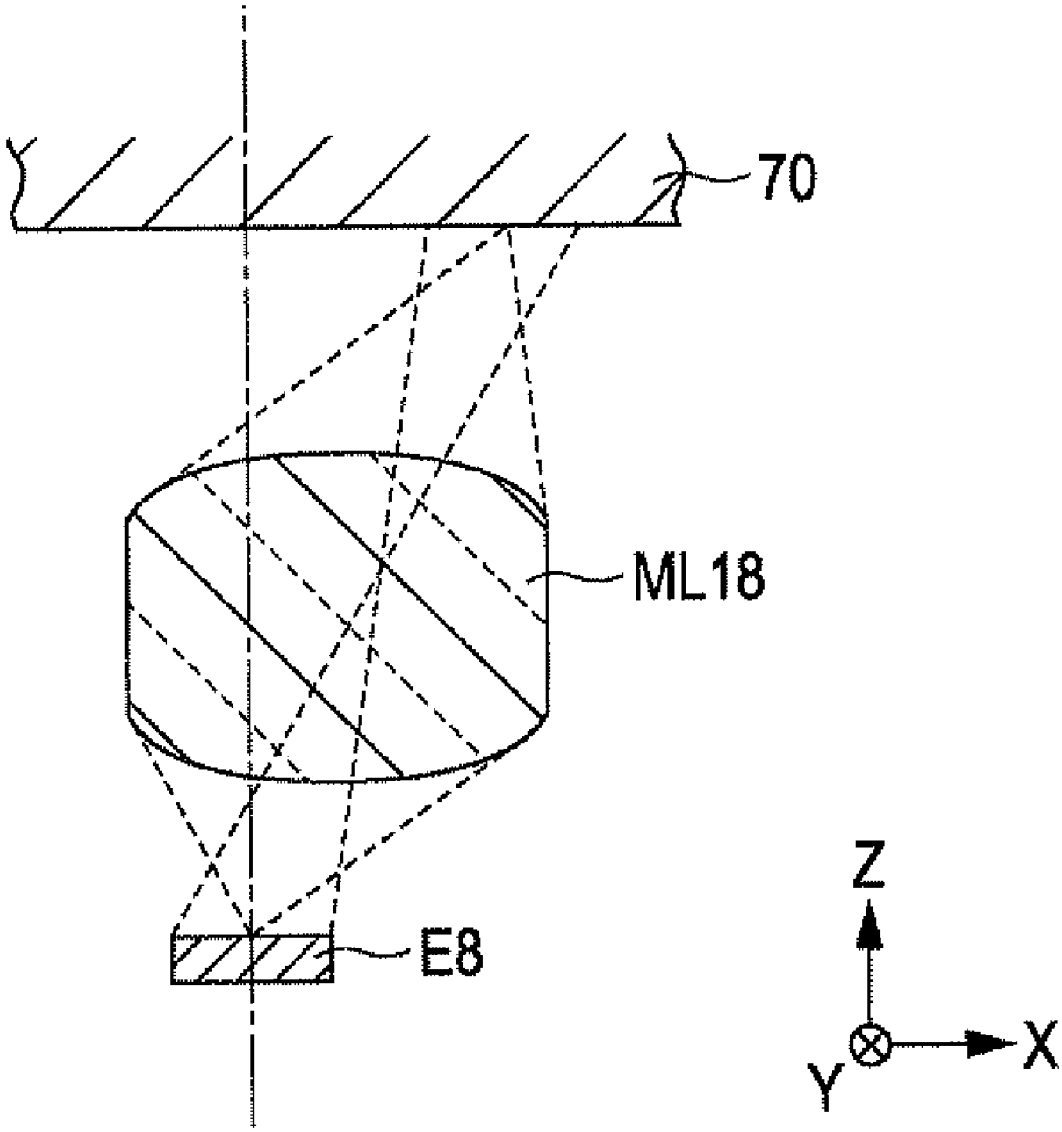
FIG. 6 is a sectional view illustrating an arrangement relationship between a light emitting element and a micro lens.

FIG. 6 is a sectional view illustrating an arrangement relationship between the light emitting element E8 and the micro lens ML18.

The micro lens ML18 is the lens of which the optical center and the geometric center coincide with each other, but is disposed with the optical axis of the lens shifted in the X direction from the light emission center of the light emitting element E8. Hence, the micro lens ML18 is able to refract the traveling direction of the light, which is emitted from the light emitting element E8, in the X direction. Further, as shown in FIG. 5, the micro lens ML18 forms the image of the light, which is emitted from the light emitting element E8, on the X-direction side from the imaging position of the light which is emitted from the light emitting element E6. Further, the micro lens ML18 is disposed with the optical axis of the lens shifted in the X direction from the light emission center of the light emitting element E8 such that the image of the light, which is emitted from the light emitting element E8, can be formed on the X-direction side from the imaging position of the light, which is emitted from the light emitting element E6, by the pitch D1.

Furthermore, the arrangement relationship between the light emitting element E7 and the micro lens ML17 is the same as the arrangement relationship between the light emitting element E8 and the micro lens ML18 reversed in the X direction. Accordingly, as shown in FIG. 5, the micro lens ML17 is able to form the image of the light, which is emitted from the light emitting element E7, on the side opposite to the X direction from the imaging position of the light which is emitted from the light emitting element E1. Further, the micro lens ML17 is disposed with the optical axis of the lens shifted in the direction opposite to the X direction from the light emission center of the light emitting element E7 such that the image of the light, which is emitted from the light emitting element E7, can be formed on the side opposite to the X direction from the imaging position of the light, which is emitted from the light emitting element E1, by the pitch D1.

Accordingly, the micro lenses ML17 and ML18 have the same functions as the micro lenses ML7 and ML8 according to the first embodiment. Hence, by controlling the light emission timing in the same manner as the first embodiment through the driving circuit, the images of the light, which is emitted from all the light emitting elements E, are formed on the outer circumferential surface of the photoconductor drum 70 in a line at the pitch D1 along the X direction.

As described above, also in the embodiment, it is possible to form the images of the light, which is emitted from the light emitting elements E7 and E8, on the outer sides from the imaging positions of the light, which is emitted from the light emitting elements E1 and E6, with the pitch D1 maintained. Accordingly, the embodiment exhibits the same effect as the first embodiment. Further, in the embodiment, it is not necessary to use the eccentric lenses similarly to the first embodiment, and all the micro lenses ML provided in the respective lens array units 24 can be formed as the lenses of which the optical centers and the geometric centers coincide with each other. In other words, it is possible to restrict the micro lenses ML provided in the respective lens array units 24 to one type, and thus it is easy to manufacture the lens array 20.

C. Third Embodiment

Next, a third embodiment will be described. Further, in the embodiment, the elements common to the first embodiment will be represented by the same reference numerals and signs, and a detailed description thereof will be appropriately omitted.

Figure 7:
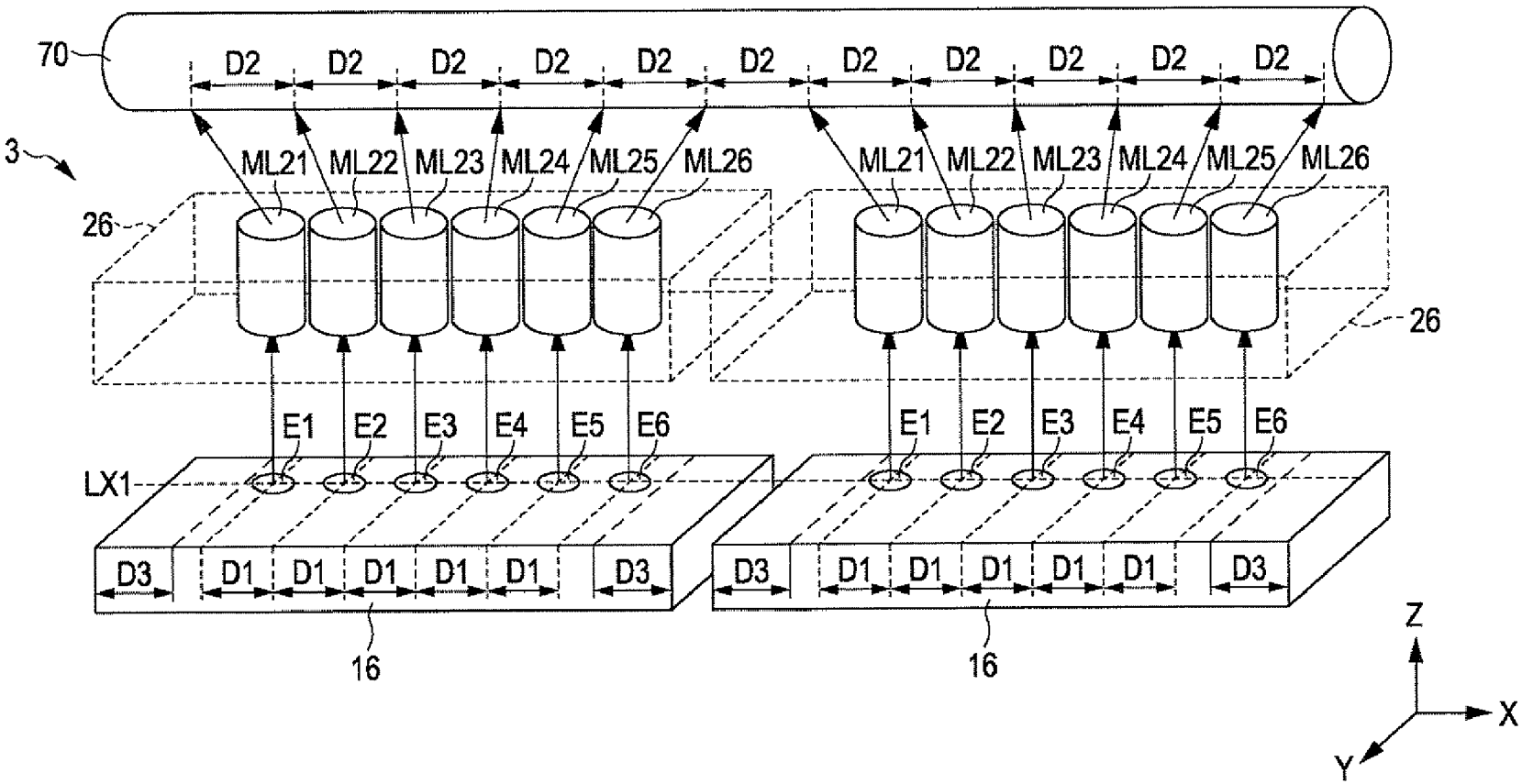
FIG. 7 is a perspective view illustrating a structure of an optical head according to a third embodiment.

FIG. 7 is a perspective view illustrating a structure of an optical head 3 according to the third embodiment.

Each light emitting element chip 16 has a configuration in which the light emitting elements E7 and E8 are removed from the light emitting element chip 12 according to the first embodiment. Thus, the six light emitting elements E1 to E6 are arranged in a line at a pitch D1 along the X direction. Further, in each lens array unit 26, micro lenses ML21 to ML26 are formed at positions opposed to the light emitting elements E1 to E6. The six micro lenses ML21 to ML26 are lenses of which the optical centers and the geometric centers coincide with each other, and are arranged in a line along the X direction. Furthermore, the number of groups of the light emitting element E and the micro lens ML is not limited to 6.

Figure 8:
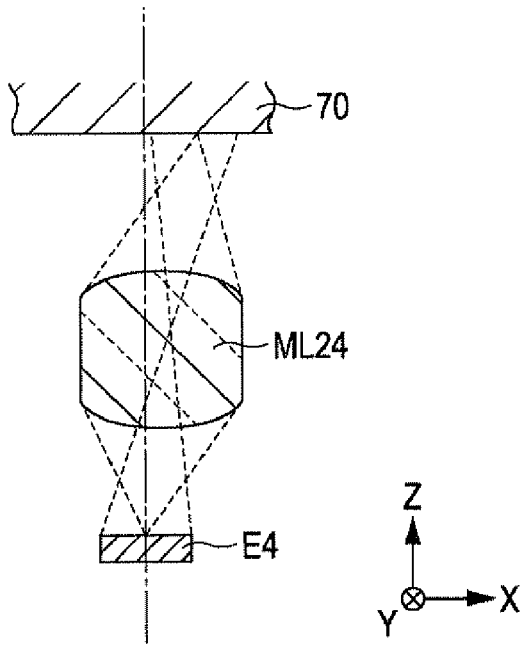
FIG. 8 is a sectional view illustrating an arrangement relationship between a light emitting element and a micro lens.

FIG. 8 is a sectional view illustrating an arrangement relationship between the light emitting element E4 and the micro lens ML24. Further, FIG. 9 is a sectional view illustrating an arrangement relationship between the light emitting element E6 and the micro lens ML26.

Figure 9:
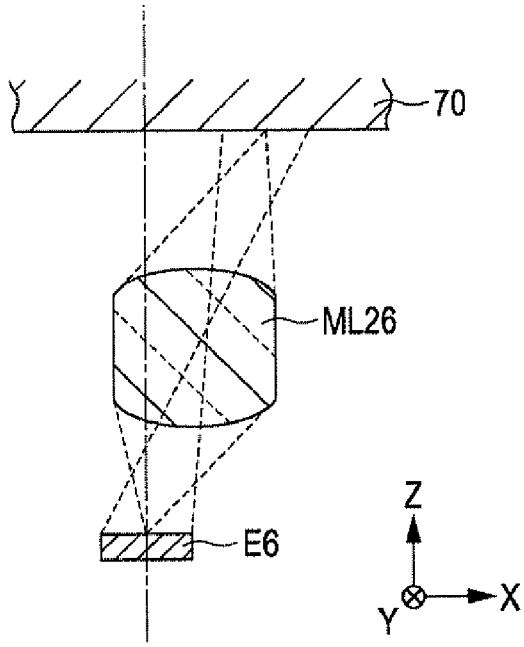
FIG. 9 is a sectional view illustrating an arrangement relationship between a light emitting element and a micro lens.

As shown in FIGS. 8 and 9, the micro lens ML24 (ML26) is disposed with the optical axis of the lens shifted in the X direction from the light emission center of the light emitting element E4 (E6). Hence, the micro lens ML24 (ML26) is able to refract the traveling direction of the light, which is emitted from the light emitting element E4 (E6), in the X direction. Further, regarding the shift length between the optical axis and the light emission center of the lens in the X direction, the shift length of the micro lens ML26 is larger than that of the micro lens ML24. Accordingly, regarding the angle of refracting the emitted light in the X direction, the refraction angle of the micro lens ML26 is larger than that of the micro lens ML24.

Further, the arrangement relationship between the light emitting element E1 and the micro lens ML21 is the same as the arrangement relationship between the light emitting element E6 and the micro lens ML26 reversed in the X direction. Furthermore, the arrangement relationship between the light emitting element E3 and the micro lens ML23 is the same as the arrangement relationship between the light emitting element E4 and the micro lens ML24 reversed in the X direction. Accordingly, the micro lens ML21 (ML23) is disposed with the optical axis of the lens shifted in the direction opposite, to the X direction from the light emission center of the light emitting element E1 (E3). Hence, the micro lens ML21 (ML23) is able to refract the traveling direction of the light, which is emitted from the light emitting element E1 (E3), in the direction opposite to the X direction. Further, regarding the shift length between the optical axis and the light emission center of the lens in the X direction, the shift length of the micro lens ML21 is larger than that of the micro lens ML23. Accordingly, regarding the angle of refracting the emitted light in the direction opposite to the X direction, the refraction angle of the micro lens ML21 is larger than that of the micro lens ML23.

As described above, in the micro lenses ML24 to ML26, the angle of refracting the light, which is emitted from the light emitting element E opposed to the corresponding lens, in the X direction increases in order of the micro lens ML24→the micro lens ML25→the micro lens ML26. Accordingly, the shift length between the light emission center and the optical axis of the lens in the X direction also increases in order of ML24 and E4→ML25 and E5→ML26 and E6. In contrast, in the micro lenses ML21 to ML23, the angle of refracting the light, which is emitted from the light emitting element E opposed to the corresponding lens, in the direction opposite to the X direction increases in order of the micro lens ML23→the micro lens ML22→the micro lens ML21. Accordingly, the shift length between the light emission center and the optical axis of the lens in the X direction also increases in order of ML23 and E3→ML22 and E2→ML16 and E1.

That is, as the array position of the micro lenses ML21 to ML26 in each lens array unit 26 gets closer to the end of the array than the center thereof, the angle of refracting the light, which is emitted from the light emitting element E opposed to the corresponding lens, in a direction from the center toward the end increases. Further, the micro lenses ML21 to ML26 are disposed with the optical axes of the lenses shifted from the light emission centers of the light emitting elements E such that the images of the light, which is emitted from the light emitting elements E1 to E6, can be formed on the surface of the photoconductor drum 70 in a line in the X direction at the pitch D2 larger than the pitch D1 which is the array space of the light emitting elements E1 to E6. Accordingly, the images of the light, which is emitted from the light emitting elements E1 to E6, are formed on the surface of the photoconductor drum 70 in a line at the pitch D2 along the X direction. Furthermore, in the embodiment, all the light emitting elements E are arranged in a line in the X direction, and thus it is not necessary to delay the light emission timing of each light emitting element E by the driving circuit similarly to the first embodiment.

As described above, according to the embodiment, the images of the light, which is emitted from the light emitting elements E1 and E6 positioned at both ends among the light emitting elements E1 to E6 arranged in the light emitting element chip 16, are formed on the outer side from the positions, which correspond to the light emitting elements E1 and E6, on the surface of the photoconductor drum 70 with the pitch D2 maintained. That is, it is possible to form the images of the light, which is emitted from the light emitting elements E1 and E6, on a part of the surface of the photoconductor drum 70 corresponding to the frame portion of the light emitting element chip 16. Accordingly, the embodiment exhibits the same effect as the first embodiment. Further, it is not necessary to delay the light emission timing of each light emitting element E by the driving circuit similarly to the first or second embodiment. Hence, it is possible to simplify the configuration for the control of the driving circuit.

Furthermore, the eccentric lens may be used in the micro lenses ML21 to ML26. When eccentric lenses are used, the degree of eccentricity of each of the micro lenses ML24 to ML26 is set such that the light, which is emitted from the light emitting element E opposed to the corresponding lens, can be refracted in the X direction. Further, the degree of eccentricity of each of the micro lenses ML24 to ML26 increases in order of the micro lens ML24→the micro lens ML25→the micro lens ML26. In contrast, the degree of eccentricity of each of the micro lenses ML21 to ML23 is set such that the light, which is emitted from the light emitting element E opposed to the corresponding lens, can be refracted in the direction opposite to the X direction. Further, the degree of eccentricity of each of the micro lenses ML21 to ML23 increases in order of the micro lens ML23→the micro lens ML22→the micro lens ML21. As described above, when the eccentric lenses are used, the degree of eccentricity of each micro lens ML increases as the array position of the lens in each lens array unit 26 gets closer to the end of the array than the center thereof. In addition, the degree of eccentricity thereof is set such that the images of the light, which is emitted from the light emitting elements E1 to E6, can be formed in a line at the pitch D2 along the X direction.

D. Fourth Embodiment

Next, a fourth embodiment will be described. Further, in the embodiment, the elements common to the first embodiment will be represented by the same reference numerals and signs, and a detailed description thereof will be appropriately omitted.

Figure 10:
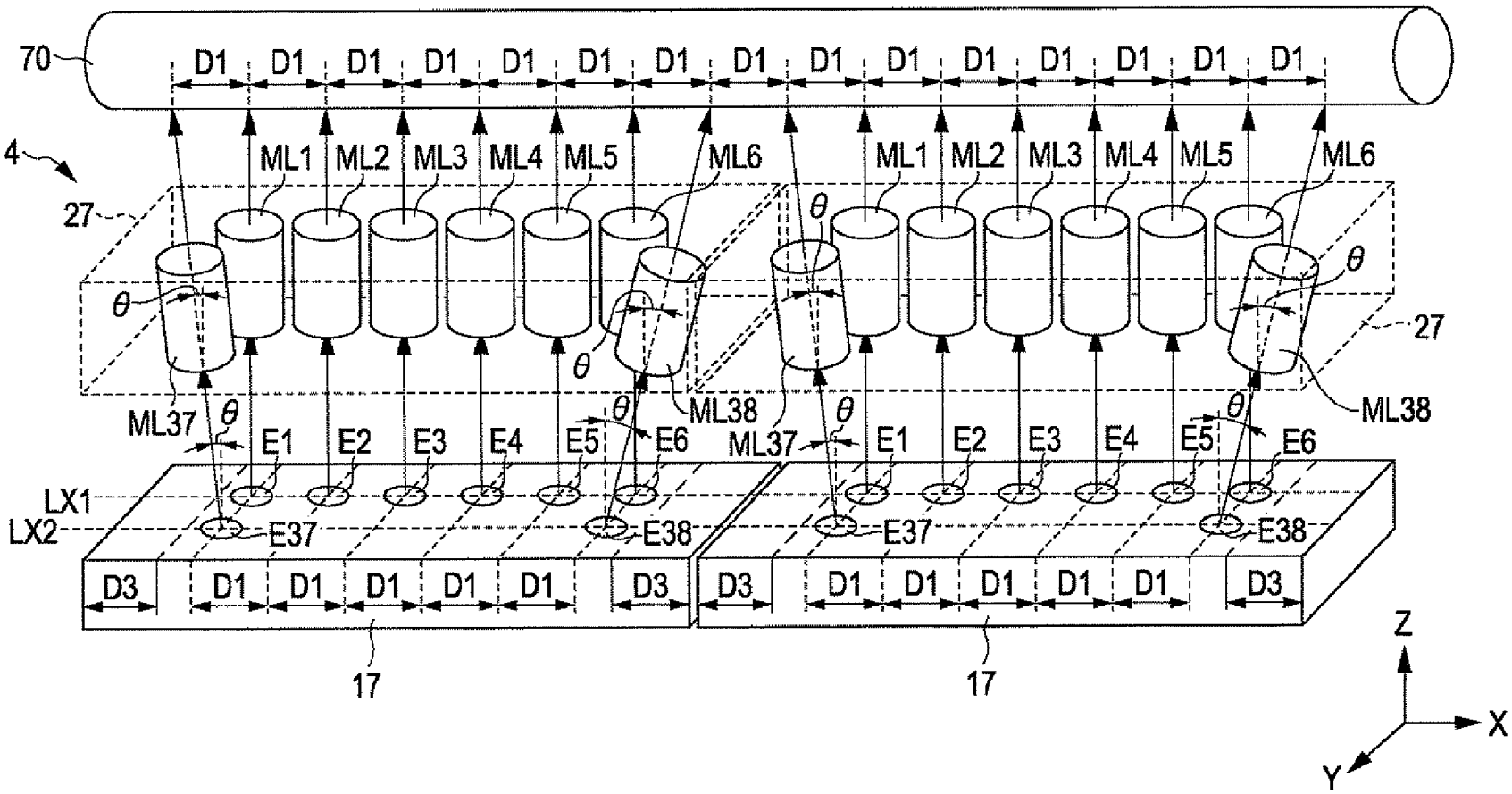
FIG. 10 is a perspective view illustrating a structure of an optical head according to a fourth embodiment.

FIG. 10 is a perspective view illustrating a structure of an optical head 4 according to the fourth embodiment.

The optical head 4 according to the embodiment is different from the optical head 1 of the first embodiment only in light emitting elements E37 and E38 provided in each light emitting element chip 17 and micro lenses ML37 and ML38 provided in each lens array unit 27. All eight micro lenses ML1 to ML6, ML37, and ML38 provided in each lens array unit 27 are lenses of which the optical centers and the geometric centers coincide with each other. However, the respective optical axes of the micro lenses ML1 to ML6 are set in the Z direction, while the respective optical axes of the micro lenses ML37 and ML38 are set to be tilted at an angle θ with respect to the Z axis.

The optical axis of the micro lens ML37 coincides with the direction of the emitted light from the light emitting element E37, and the optical axis of the micro lens ML38 coincides with the direction of the emitted light from the light emitting element E38. Further, the micro lens ML37 and the light emitting element E37 are disposed such that the light emission center of the light emitting element E37 is at the position to which the optical axis of the micro lens ML37 extends. In addition, the micro lens ML38 and the light emitting element E38 are disposed such that the light emission center of the light emitting element E38 is at the position to which the optical axis of the micro lens ML38 extends.

Figure 11:
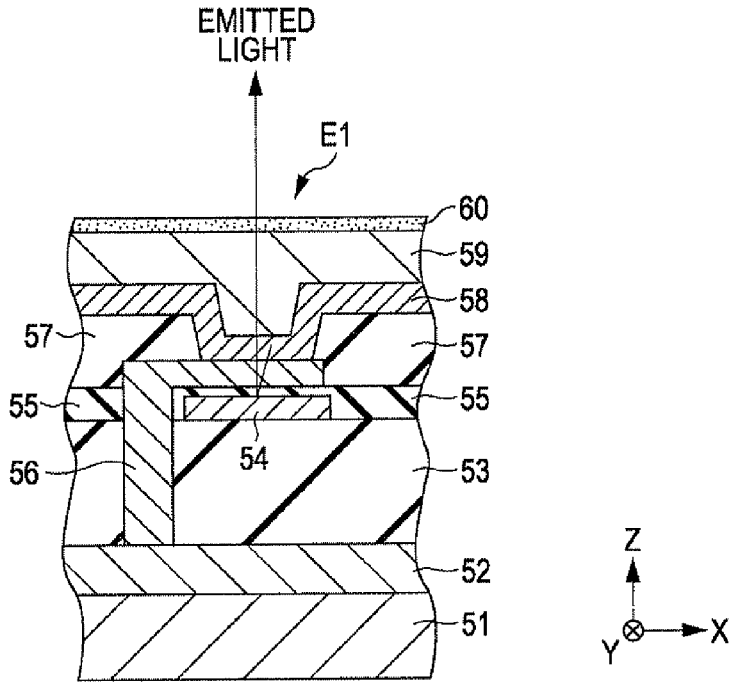
FIG. 11 is a sectional view illustrating a structure of the light emitting element.

FIG. 11 is a sectional view illustrating a structure of the light emitting element E1.

The optical head 4 according to the embodiment is a top emission type. Accordingly, as a base material 51 of the light emitting element chip 17, it is possible to employ an opaque plate material such as ceramics or a metal sheet other than an optically transparent plate material such as glass. A wire layer 52 is formed on the surface of the base material 51. The wire layer 52 includes an active element (transistor) that controls the light amount of the light emitting element E1 and a wire that transfer various signals. Further, the surface of the wire layer 52 is covered by a foundation layer 53. The foundation layer 53 is a film formed of various insulation materials such as acryl-based and epoxy-based resin materials or inorganic materials of silicon oxide (SiOx) and silicon nitride (SiNx).

A light reflecting layer 54 for the light emitting element E1 is formed on the surface of the foundation layer 53. The light reflecting layer 54 is formed of a light reflective material such as an elementary metal of aluminum, silver, or the like or a metal composition including aluminum or silver as a dominant component. The light reflecting layer 54 reflects the light, which is emitted from the light emitting layer 58, toward the upper side of the drawing. The surface of the foundation layer 53 having the light reflecting layer 54 formed thereon is coated with the transmissive layer 55. The transmissive layer 55 is a film used for protecting the light reflecting layer 54, and is formed of an insulation material with optical transparency such as silicon oxide or silicon nitride.

A first electrode 56, which functions as an anode of the light emitting element E1, is formed on the surface of the transmissive layer 55. The first electrode 56 is formed of a transparent conductive material such as ITO (indium tin oxide), ZnO (zinc oxide), or IZO (indium zinc oxide). Further, a part of the first electrode 56 is electrically connected to the wire layer 52 through a contact hole which penetrates through the transmissive layer 55 and the foundation layer 53. Thereby, the first electrode 56 is able to supply predetermined current to the light emitting layer 58. An insulation layer 57 is formed on the surface of the transmissive layer 55 having the first electrode 56 formed thereon. The insulation layer 57 is an insulation film on which an opening portion (a hole which penetrates through the insulation layer 57 in the thickness direction) is formed in an area where the insulation layer 57 and the first electrode 56 overlap with each other as viewed in the Z direction.

The first electrode 56 and the insulation layer 57 are covered by a light emitting layer 58. The light emitting layer 58 includes at least the organic light emitting layer, and the organic light emitting layer is constituted of an organic EL material which emits light by the coupling between electrons and holes. The light emitting layer 58 is continuously formed throughout a plurality of light emitting elements E by a coating technique such as a spin coating method. As described above, the light emitting layer 58 is continuously formed throughout the plurality of light emitting elements E. However, the first electrode 56 is separately formed for each light emitting element E. Hence, the light amount is individually controlled for each light emitting element E in accordance with the current supplied from the first electrode 56. However, the light emitting layer 58 may be independently formed for each light emitting element E by a liquid droplet ejecting method (an ink jet method). Further, as other layers constituting the light emitting layer 58, some or all of an electron blocking layer, hole injection layer, hole transport layer, electron transport layer, electron injection layer, and hole blocking layer may be provided.

The surface of the light emitting layer 58 is covered by a second electrode 59 which functions as a cathode of the light emitting element E1. The second electrode 59 is formed of an optically transparent conductive material such as ITO. Further, the second electrode 59 is continuously formed throughout the plurality of light emitting elements E. The surface of the second electrode 59 is covered by a sealing layer 60. The light emitting layer 58 emits light with an intensity depending on the driving current which flows from the first electrode 56 to the second electrode 59. Furthermore, since current does not flow in the area where the insulation layer 57 is interposed between the first electrode 56 and the second electrode 59, the portion, in which the light emitting layer 58 and the insulation layer 57 overlap with each other, does not emit light. Accordingly, in the accumulated layers of the first electrode 56, the insulation layer 57, the light emitting layer 58, and the second electrode 59, the portion positioned inside the opening portion of the insulation layer 57 functions as the light emitting element E1.

The light, which is emitted from the light emitting layer 58 toward the second electrode 59, is transmitted through the second electrode 59 and the sealing layer 60, and is emitted to the photoconductor drum 70. Further, as indicated by the arrow in the drawing, when the light which is emitted from the light emitting layer 58 toward the first electrode 56 is transmitted through the first electrode 56 and the transmissive layer 55 and reaches the light reflecting layer 54, the light is reflected to the upper side of the drawing by the light reflecting layer 54, is transmitted through the transmissive layer 55, the first electrode 56, the light emitting layer 58, the second electrode 59, and the sealing layer 60, and is emitted to the photoconductor drum 70. As described, the light emitting element E1 emits the light, which originates from the light emitting layer 58, in the Z direction.

Furthermore, the light emitting elements E2 to E6 also have the same structure as the light emitting element E1. Accordingly, as shown in FIG. 10, all the light emitting elements E1 to E6 emit light in the Z direction. Further, the light emitting elements En (n=1 to 6) and the micro lenses MLn (n=1 to 6) are opposed to each other such that the light emission center of the light emitting element En coincides with the optical axis of the micro lens MLn. Accordingly, the images of the light, which is emitted from the light emitting elements E1 to E6, are formed on the surface of the photoconductor drum 70 in a line at the pitch D1 along the X direction.

Figure 12:
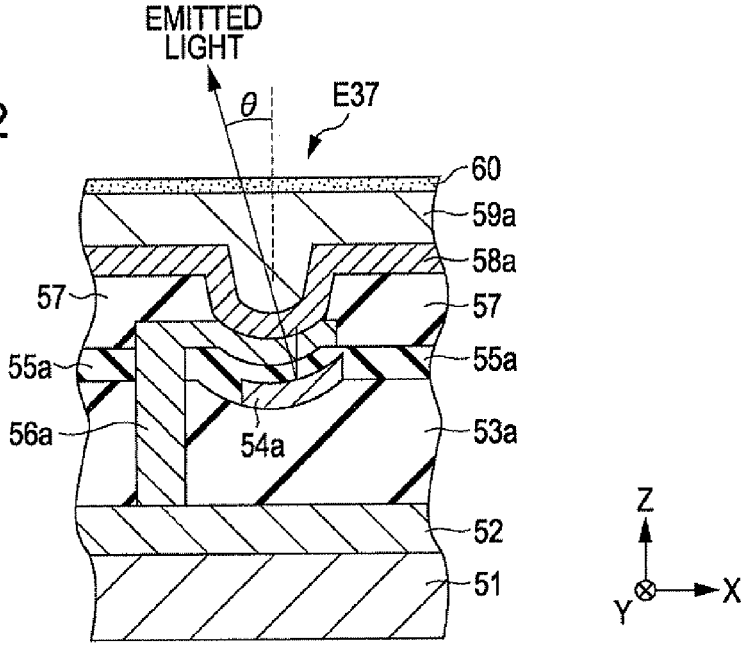
FIG. 12 is a sectional view illustrating a structure of a light emitting element.

FIG. 12 is a sectional view illustrating a structure of the light emitting element E37.

Furthermore, in the drawing, common elements in FIG. 11 are represented by the same reference numerals and signs. A curved hollow is formed on a portion of the surface of a foundation layer 53*a* corresponding to the opening portion of the insulation layer 57. A light reflecting layer 54*a* with a regular thickness is formed on a right side portion of the hollow in the drawing. Accordingly, the light reflecting layer 54*a* is different from the light reflecting layer 54 shown in FIG. 11 in that the light reflecting layer 54*a* has a curved shape and in terms of the angle of a disposed light emitting layer 58*a* thereto. Further, the direction of the light reflected by the light reflecting layer 54*a* is, as indicated by the arrow of the drawing, set to a direction in which the Z axis is tilted at the angle θ in the direction opposite to the X direction. Furthermore, in FIG. 12, there is a difference from the case of FIG. 11 not only in the light reflecting layer 54*a* but also in the shapes of portions of a transmissive layer 55*a*, a first electrode 56*a*, the light emitting layer 58*a* and a second electrode 59*a*, which are laminated on the light reflecting layer 54*a*, corresponding to the hollow.

Further, although not shown in the drawings, a spacer formed of a material having a light blocking effect is disposed between the light emitting element chip 17 and the lens array unit 27. The spacer has eight through-holes that are formed to make the light, which is emitted from each light emitting element E, incident to each micro lens ML corresponding thereto. However, the center axis of each through-hole, which connects the light emitting element E37 to the micro lens ML37, coincides with the direction of the light reflected by the light emitting element E37 (the light reflecting layer 54*a*). Thus, the direction of the light emitted from the light emitting element E37 is set to a direction in which the Z axis is tilted at the angle θ in the direction opposite to the X direction.

Further, as described above, the slope of the optical axis of the micro lens ML37 coincides with the direction of the emitted light from the light emitting element E37. Hence, as shown in FIG. 10, the image of the light, which is emitted from the light emitting element E37, is formed on the side opposite to the X direction from the imaging position of the light which is emitted from the light emitting element E1. Furthermore, the direction of the light, which is emitted from the light emitting element E37, and the slope of the optical axis of the micro lens ML37 is set such that the image of the light, which is emitted from the light emitting element E37, can be formed on the side opposite to the X direction from the imaging position of the light, which is emitted from the light emitting element E1, by the pitch D1.

Further, the structure of the light emitting element E38 is the same as the structure of the light emitting element E37, which is shown in FIG. 12, reversed in the X direction. Furthermore, in a spacer which is not shown, the center axis of each through-hole, which connects the light emitting element E38 to the micro lens ML38, coincides with the direction of the light reflected by the light emitting element E38. Thus, the direction of the light emitted from the light emitting element E38 is set to a direction in which the Z axis is tilted at the angle θ in the X direction. Further, the slope of the optical axis of the micro lens ML38 coincides with the direction of the emitted light from the light emitting element E38. Hence, as shown in FIG. 10, the image of the light, which is emitted from the light emitting element E38, is formed on the X-direction side from the imaging position of the light which is emitted from the light emitting element E6. Furthermore, the direction of the light, which is emitted from the light emitting element E38, and the slope of the optical axis of the micro lens ML38 is set such that the image of the light, which is emitted from the light emitting element E38, can be formed on the X-direction side from the imaging position of the light, which is emitted from the light emitting element E6, by the pitch D1.

Hence, the driving circuit controls the light emission timings of the light emitting elements E1 to E6 and the light emission timings of the light emitting elements E37 and E38 as in the case of the first embodiment, whereby the images of the light, which is emitted from all the light emitting elements E, are formed on the outer circumferential surface of the photoconductor drum 70 in a line at the pitch D1 along the X direction. As described above, in the embodiment, it is also possible to form the images of the light, which is emitted from the light emitting elements E37 and E38, on the outer sides from the imaging positions of the light, which is emitted from the light emitting elements E1 and E6, with the pitch D1 maintained. Accordingly, the embodiment exhibits the same effect as the first embodiment.

Figure 13:
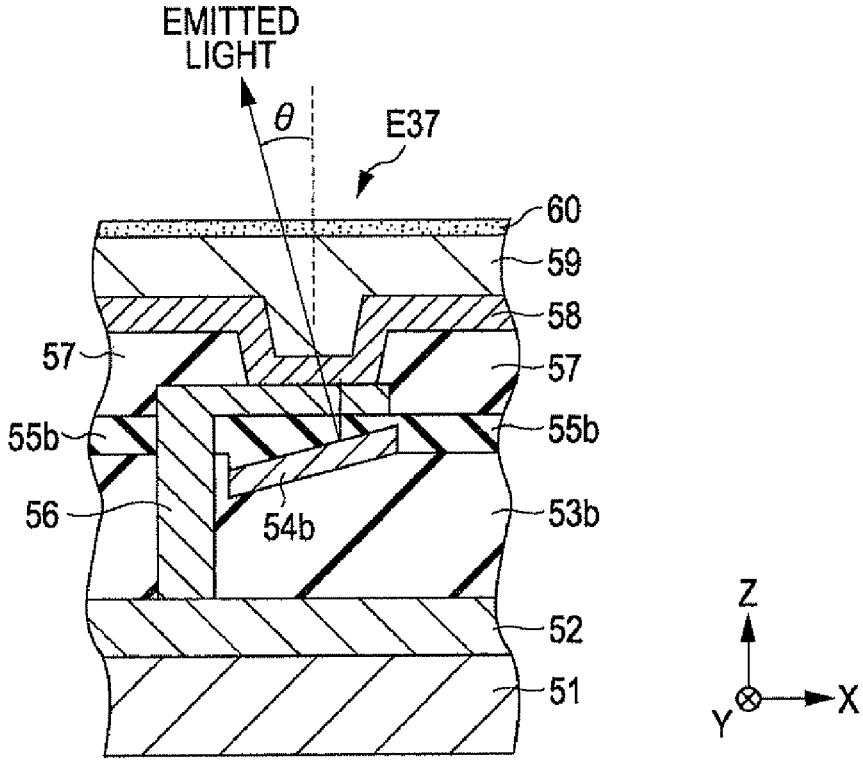
FIG. 13 is a sectional view (Modified Example) illustrating a structure of the light emitting element.
Figure 14:
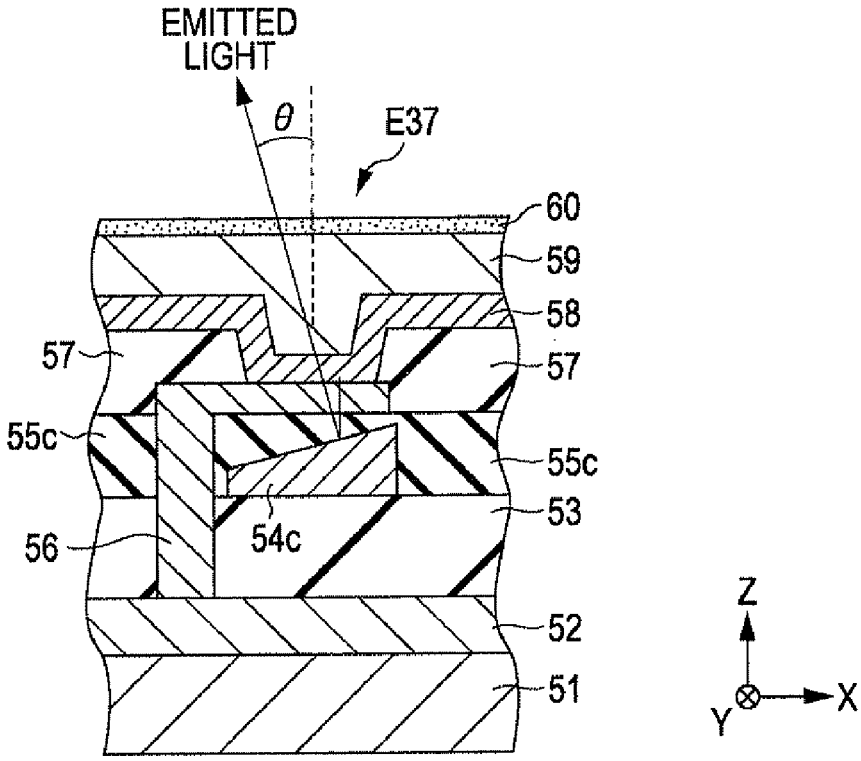
FIG. 14 is a sectional view (Modified Example) illustrating a structure of the light emitting element.

Further, the light emitting element E37 may have the structure shown in FIG. 13 or 14. That is, as shown in FIG. 13, the light emitting element E37 may have a structure which is different from the case of FIG. 11 only in the angle of the disposed reflection layer 54*b* to the light emitting layer 58. In this case, a hollow, of which the bottom surface is tilted at the angle θ, is formed on a portion of the surface of a foundation layer 53*b* corresponding to the opening portion of the insulation layer 57. A light reflecting layer 54*b* with a regular thickness is formed on the portion of the hollow in the drawing. Further, as shown in FIG. 14, the light emitting element E37 may be configured such that the reflection layer 54*c*, of which the upper surface is tilted at the angle θ, is formed on the surface of the foundation layer 53. The above-mentioned configurations are the same in the light emitting element E38.

E. Fifth Embodiment

Next, a fifth embodiment will be described. Further, in the embodiment, the elements common to the first embodiment will be represented by the same reference numerals and signs, and a detailed description thereof will be appropriately omitted.

Figure 15:
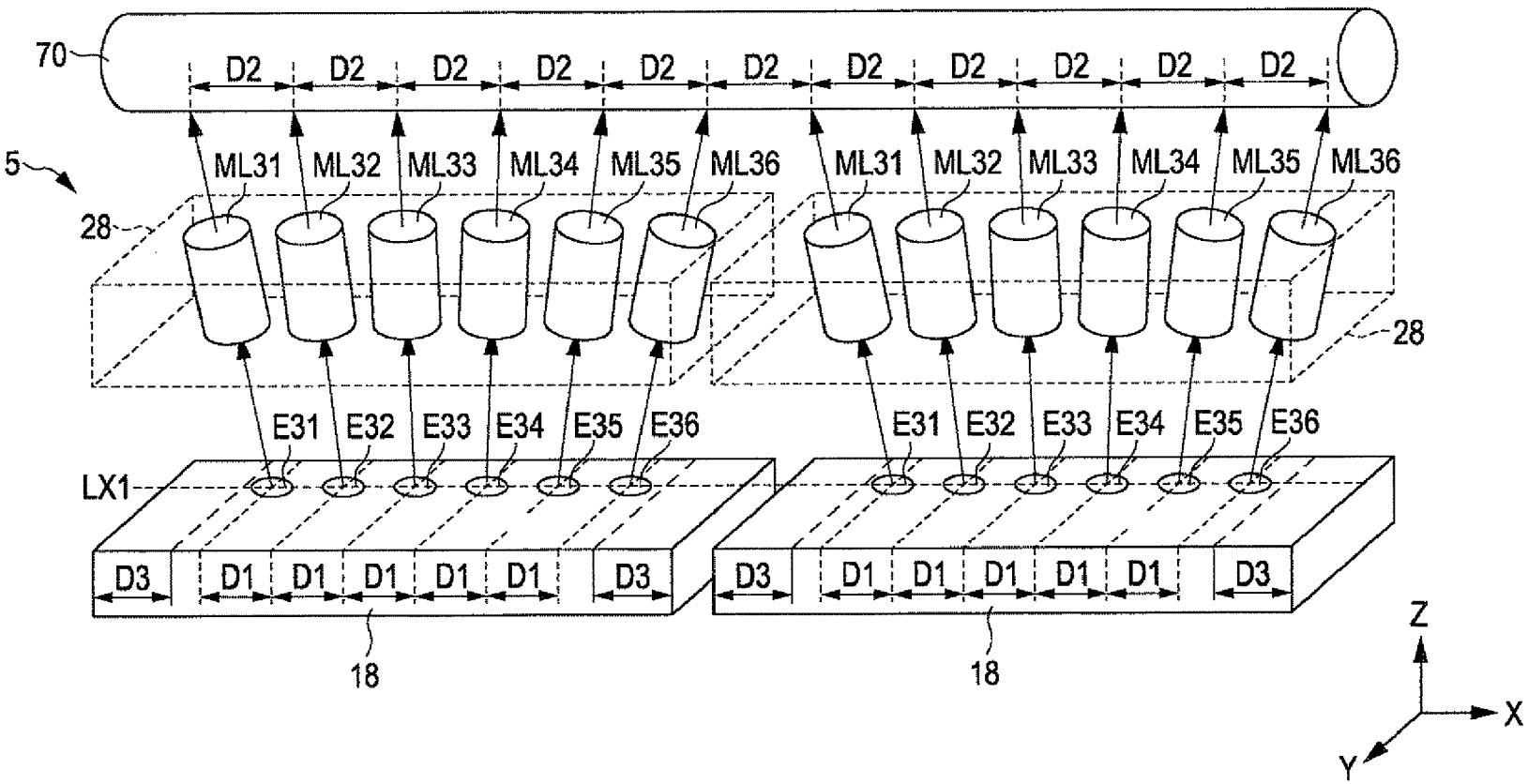
FIG. 15 is a perspective view illustrating a structure of an optical head according to a fifth embodiment.

FIG. 15 is a perspective view illustrating a structure of an optical head 5 according to the fifth embodiment.

In each light emitting element chip 18, the six light emitting elements E31 to E36 are arranged in a line at the pitch D1 along the X direction. Further, in each lens array unit 28, six micro lenses ML31 to ML36 are arranged in a line along the X direction. The six micro lenses ML31 to ML36 are lenses of which the optical centers and the geometric centers coincide with each other.

Further, the optical axis of the micro lens ML31 coincides with the direction of the emitted light from the light emitting element E31, the optical axis of the micro lens ML32 coincides with the direction of the emitted light from the light emitting element E32, . . . , and the optical axis of the micro lens ML36 coincides with the direction of the emitted light from the light emitting element E36. That is, the slopes of the optical axes of the micro lenses MLn (n=31 to 36) coincide with the directions of the emitted light of the light emitting elements En (n=31 to 36). Further, the micro lens ML31 and the light emitting element E31 are disposed such that the light emission center of the light emitting element E31 is at the position to which the optical axis of the micro lens ML31 extends, the micro lens ML32 and the light emitting element E32 are disposed such that the light emission center of the light emitting element E32 is at the position to which the optical axis of the micro lens ML32 extends, . . . , and the micro lens ML36 and the light emitting element E36 are disposed such that the light emission center of the light emitting element E36 is at the position to which the optical axis of the micro lens ML36 extends.

Figure 16:
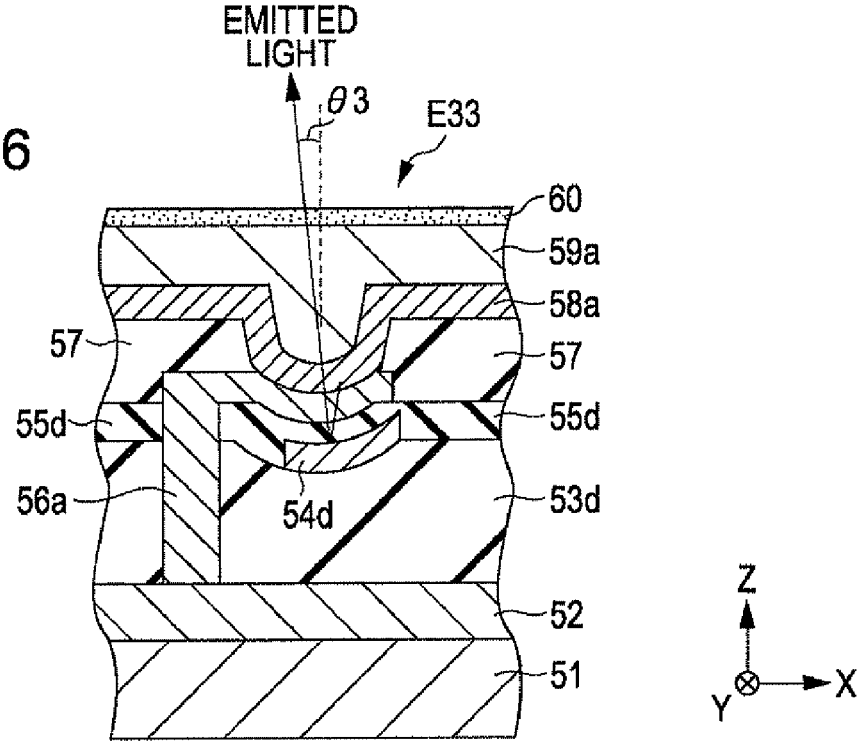
FIG. 16 is a sectional view illustrating a structure of a light emitting element.
Figure 17:
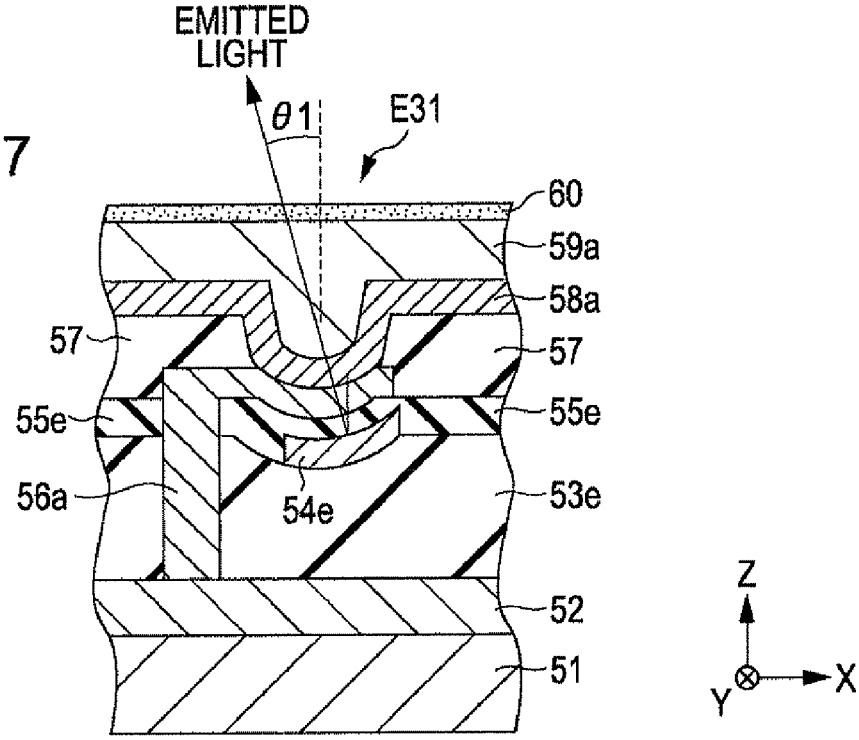
FIG. 17 is a sectional view illustrating a structure of a light emitting element.

FIG. 16 is a sectional view illustrating a structure of the light emitting element E33. Further, FIG. 17 is a sectional view illustrating a structure of the light emitting element E31. Furthermore, in FIGS. 16 and 17, common elements in FIG. 12 are represented by the same reference numerals and signs. As can be clearly seen from FIGS. 16 and 17, the light emitting element E33 and the light emitting element E31 are different in the angles of disposed light reflecting layers 54*d* and 54*e* to the light emitting layer 58*a*. That is, in the case of FIG. 16, the hollow, which is formed on the surface of the foundation layer 53*d*, is shallow, and the light reflecting layer 54*d* is formed near the center of the hollow. Therefore, the direction of the light, which is reflected by the light reflecting layer 54*d*, is set to a direction in which the Z axis is tilted at the angle θ3 in the direction opposite to the X direction. In contrast, in the case of FIG. 17, the hollow, which is formed on the surface of the foundation layer 53*e*, is deep, and the light reflecting layer 54*e* is formed near the right side of the hollow. Therefore, the direction of the light, which is reflected by the light reflecting layer 54*e*, is set to a direction in which the Z axis is tilted at the angle θ1 (<θ3) in the direction opposite to the X direction.

Further, although not shown in the drawings, a spacer formed of a material having a light blocking effect is disposed between the light emitting element chip 18 and the lens array unit 28. The spacer has six through-holes that are formed to make the light, which is emitted from each light emitting element E, incident to each micro lens ML corresponding thereto. However, the center axis of each through-hole, which connects the light emitting element E33 to the micro lens ML33, coincides with the direction of the light reflected by the light emitting element E33 (the light reflecting layer 54*d*). In addition, the center axis of each through-hole, which connects the light emitting elements E31 to the micro lens ML31, coincides with the direction of the light reflected by the light emitting element E31 (the light reflecting layer 54*e*).

Accordingly, the direction of the light emitted from the light emitting element E33 is set to a direction in which the Z axis is tilted at the angle θ3 in the direction opposite to the X direction. Further, the direction of the light emitted from the light emitting element E31 is set to a direction in which the Z axis is tilted at the angle θ1 (>θ3) in the direction opposite to the X direction. Further, although not shown in the drawings, the direction of the light emitted from the light emitting element E32 is set to a direction in which the Z axis is tilted at the angle θ2 (θ1>θ2>θ3) in the direction opposite to the X direction. As described above, the direction of the light, which is emitted from each of the light emitting elements E31 to E33, has a slope, which increases in order of the light emitting element E33→the light emitting element E32→the light emitting element E31, with respect to the Z axis.

Further, as described above, the slope of the optical axis of each micro lens MLn (n=31 to 36) coincides with the direction of the emitted light from each light emitting element En (n=31 to 36). Accordingly, in FIG. 15, the optical axis of the micro lens ML33 is set to be tilted at the angle θ3 in the direction opposite to the X direction with respect to the Z axis. The optical axis of the micro lens ML32 is set to be tilted at the angle θ2 in the direction opposite to the X direction with respect to the Z axis. The optical axis of the micro lets ML31 is set to be tilted at the angle θ1 in the direction opposite to the X direction with respect to the Z axis.

Further, the structure of the light emitting element E34 is the same as the structure of the light emitting element E33, which is shown in FIG. 16, reversed in the X direction. Furthermore, the structure of the light emitting element E36 is the same as the structure of the light emitting element E31, which is shown in FIG. 17, reversed in the X direction. Further, in a spacer which is not shown, the center axis of each through-hole, which connects the light emitting element E34 to the micro lens ML34, coincides with the direction of the light reflected by the light emitting element E34. In addition, the center axis of each through-hole, which connects the light emitting element E36 to the micro lens ML36, coincides with the direction of the light reflected by the light emitting element E36. Thus, the direction of the light emitted from the light emitting element E34 is set to a direction in which the Z axis is tilted at the angle θ3 in the X direction. In addition, the direction of the light emitted from the light emitting element E36 is set to a direction in which the Z axis is tilted at the angle θ1 (>θ3) in the X direction. Further, the structure of the light emitting element E35 is the same as the structure of the light emitting element E32 reversed in the X direction. Hence, the direction of the light emitted from the light emitting element E35 is set to a direction in which the Z axis is tilted at the angle θ2 (θ1>η2>θ3) in the X direction. As described above, the direction of the light, which is emitted from each of the light emitting elements E34 to E36, has a slope, which increases in order of the light emitting element E34→the light emitting element E35→the light emitting element E36, with respect to the Z axis.

Further, as described above, the slope of the optical axis of each micro lens MLn (n=31 to 36) coincides with the direction of the emitted light from each light emitting element En (n=31 to 36). Accordingly, in FIG. 15, the optical axis of the micro lens ML34 is set to be tilted at the angle θ3 in the X direction with respect to the Z axis. The optical axis of the micro lens ML35 is set to be tilted at the angle θ2 in the X direction with respect to the Z axis. The optical axis of the micro lens ML36 is set to be tilted at the angle θ1 in the X direction with respect to the Z axis.

As described above, as the array position of the light emitting elements E31 to E36 in the light emitting element chip 18 gets closer to the end of the array than the center thereof, the slope of the emission direction with respect to the Z axis increases. Further, the direction of the emitted light from each light emitting element E and the slope of the optical axis of each micro lens ML are set such that the images of the light, which is emitted from the light emitting elements E31 to E36, can be formed on the surface of the photoconductor drum 70 in a line in the X direction at the pitch D2 larger than the pitch D1 which is the array space of the light emitting elements E31 to E36. Accordingly, as shown in FIG. 15, the images of the light, which is emitted from the light emitting elements E31 to E36, are formed on the surface of the photoconductor drum 70 in a line at the pitch D2 along the X direction. Furthermore, in the embodiment, all the light emitting elements E are arranged in a line in the X direction, and thus it is not necessary to delay the light emission timing of each light emitting element E by the driving circuit.

As described above, in the embodiment, it is also possible to form the images of the light, which is emitted from the light emitting elements E31 and E36, which are formed on the outer side from the positions and which correspond to the light emitting elements E31 and E36, on the surface of the photoconductor drum 70 with the pitch D2 maintained. Accordingly, the embodiment exhibits the same effect as the third embodiment.

F. Modified Examples

The invention is not limited to the above-mentioned embodiments, and may be modified into, for example, the following forms. Further, two or more forms in embodiments mentioned above and Modified Examples to be described later may be combined.

Modified Example 1

The positions of the light emitting elements E7 and E8 in the first embodiment are not limited to the positions shown in FIG. 2. For example, the positions of the light emitting elements E7 and E8 may be set to be closer to the center of the light emitting element chip 12 than the positions shown in FIG. 2. As described above, it is preferable that the positions, at which the light emitting elements E7 and E8 are provided, should be at positions, which are different from the positions in the straight line LX1, other than the frame portion. However, in accordance with the positions of the light emitting elements E7 and E8, it is necessary to change the degrees of eccentricity and the positions of the micro lenses ML7 and ML8. Further, as shown in FIG. 2, by providing the light emitting elements E7 and E8 at positions (except the frame portion) which are as close as possible to both ends of the light emitting element chip 12, the traveling direction of the emitted light is not heavily deflected. The above description is similarly applied to the second and fourth embodiments. However, in the case of the second embodiment, instead of the degree of eccentricity, the shift length in the X direction between the light emission center and the optical axis of the lens is adjusted. Further, in the case of the fourth embodiment, in addition to the slopes of the optical axes and the positions of the micro lenses ML37 and ML38, it is also necessary to adjust the direction of the light emitted from the light emitting elements E37 and E38.

Modified Example 2

In the first embodiment, the micro lens ML8 (the eccentric lens) may deflect the light, which is emitted from the light emitting element E8, not only in the X direction but also in the direction opposite to the Y direction. In this case, it is preferable to set the degree of eccentricity of the micro lens ML8 such that the image of the light, which is emitted from the light emitting element E8, can be formed on the position which is separated by the pitch D1 in the X direction from the imaging position of the light emitted from the light emitting element E6. This is the same in the micro lens ML7. That is, it is preferable to set the degree of eccentricity of the micro lens ML7 such that the image of the light, which is emitted from the light emitting element E7, can be formed on the position which is separated by the pitch D1 in the direction opposite to the X direction from the imaging position of the light emitted from the light emitting element E1. When the degrees of eccentricity of the micro lenses ML7 and ML8 are set in the above-mentioned manner, it is not necessary delay the light emission timings in the light emitting elements E1 to E6 and the light emitting elements E7 and E8. Hence, it is possible to simplify the configuration for the control of the driving circuit.

This is the same in the micro lenses ML17 and ML18 of the second embodiment and in the micro lenses ML37 and ML38 of the fourth embodiment. However, in the case of the second embodiment, instead of the degree of eccentricity, the shift length between the light emission center and the optical axis of the lens is adjusted even in the direction opposite to the Y direction. Further, in the case of the fourth embodiment, the slope of each optical axis of the micro lenses ML37 and ML38 is adjusted even in the direction opposite to the Y direction. Furthermore, in the case of the fourth embodiment, each direction of the light, which is emitted from the light emitting elements E37 and E38, is adjusted even in the direction opposite to the Y direction.

Modified Example 3

In the first embodiment, when the plurality of sets of the light emitting element chips 12 and the lens array units 22 are lined up in a line in the X direction, each set of the light emitting element chips 12 and the lens array units 22 positioned at both ends thereof is not neighboring to the other sets except only one adjacent set. Accordingly, for example, among two sets of the light emitting element chips 12 and the lens array units 22 shown in FIG. 2, the following elements may not be necessary: the micro lens ML7 and the light emitting element E7 in the lens array unit 22 and the light emitting element chip 12 on the left side of the drawing; and the micro lens ML8 and the light emitting element E8 in the lens array unit 22 and the light emitting element chip 12 on the right side of the drawing. Further, in all the plurality of sets of the light emitting element chips 12 and lens array units 22 lined up in a line, the light emitting element E7 and the micro lens ML7 (or the light emitting element E8 and the micro lens ML8) may not be necessary.

For example, in the configuration shown in FIG. 2, when the light emitting element E7 and the micro lens ML7 (or the light emitting element E8 and the micro lens ML8) are removed, the width D3 of the frame portion, by which the light emitting element chips 12 are lined up in a line, is maximally equal to the pitch D1. That is, when the width D3 of the frame portion is equal to or less than the pitch D1, the light emitting element chips 12 are lined up in a line in the X direction. The above description is similarly applied to the second and fourth embodiments.

Modified Example 4

For example, each light emitting element chip 12 shown in FIG. 2 may be configured such that two light emitting elements E are provided for each side in the straight line LX2, that is, a total of four light emitting elements E are provided so as to form the images of the light, which is emitted from the four light emitting elements E, on the outer sides from the imaging positions of the light which is emitted from the light emitting elements E1 and E6. With such a configuration, the width D3 of the frame portion, by which the light emitting element chips 12 can be lined up in a line, can be set to be larger. However, when the number of the light emitting elements E in the straight line LX2 is increased as described above, it is also necessary to increase the number of the micro lenses ML (the eccentric lenses). Further, it is necessary to form the image of the light, which is emitted from each light emitting element E in the straight line LX2, with the pitch D1 maintained by adjusting the degree of eccentricity of each micro lens ML. This is the same in the second and fourth embodiments. However, in the case of the second embodiment, instead of the degree of eccentricity, the shift length between the light emission center and the optical axis of the lens is adjusted. In addition, in the case of the fourth embodiment, it is necessary to adjust the direction of the light emitted from each light emitting element E provided in the straight line LX2 or the slope of the optical axis of the corresponding micro lens ML.

Further, also in the case of the third embodiment, by adjusting the shift length between the light emission center and the optical axis of the lens or the degree of eccentricity of the lens, it is possible to increase the number of the light emitting elements E which forms images on the outer side from the positions corresponding to the light emitting elements E1 and E6 on the surface of the photoconductor drum 70. Thereby, the width D3 of the frame portion, by which the light emitting element chips 16 can be lined up in a line, can be set to be larger. This is the same in the fifth embodiment. However, in the case of the fifth embodiment, it is necessary to adjust the direction of the light emitted from the light emitting elements E31 to E36 or the slope of the optical axis of the micro lenses ML31 to ML36.

Modified Example 5

In the first embodiment, the description was given of the case where, as shown in FIG. 2, one light emitting element E is disposed to be separated from each of both ends of the light emitting elements E1 to E6 in the Y direction. However, as shown in FIG. 18, two light emitting elements E are disposed to be separated from each of both ends of the light emitting elements E1 to E6 in the Y direction.

Figure 18:
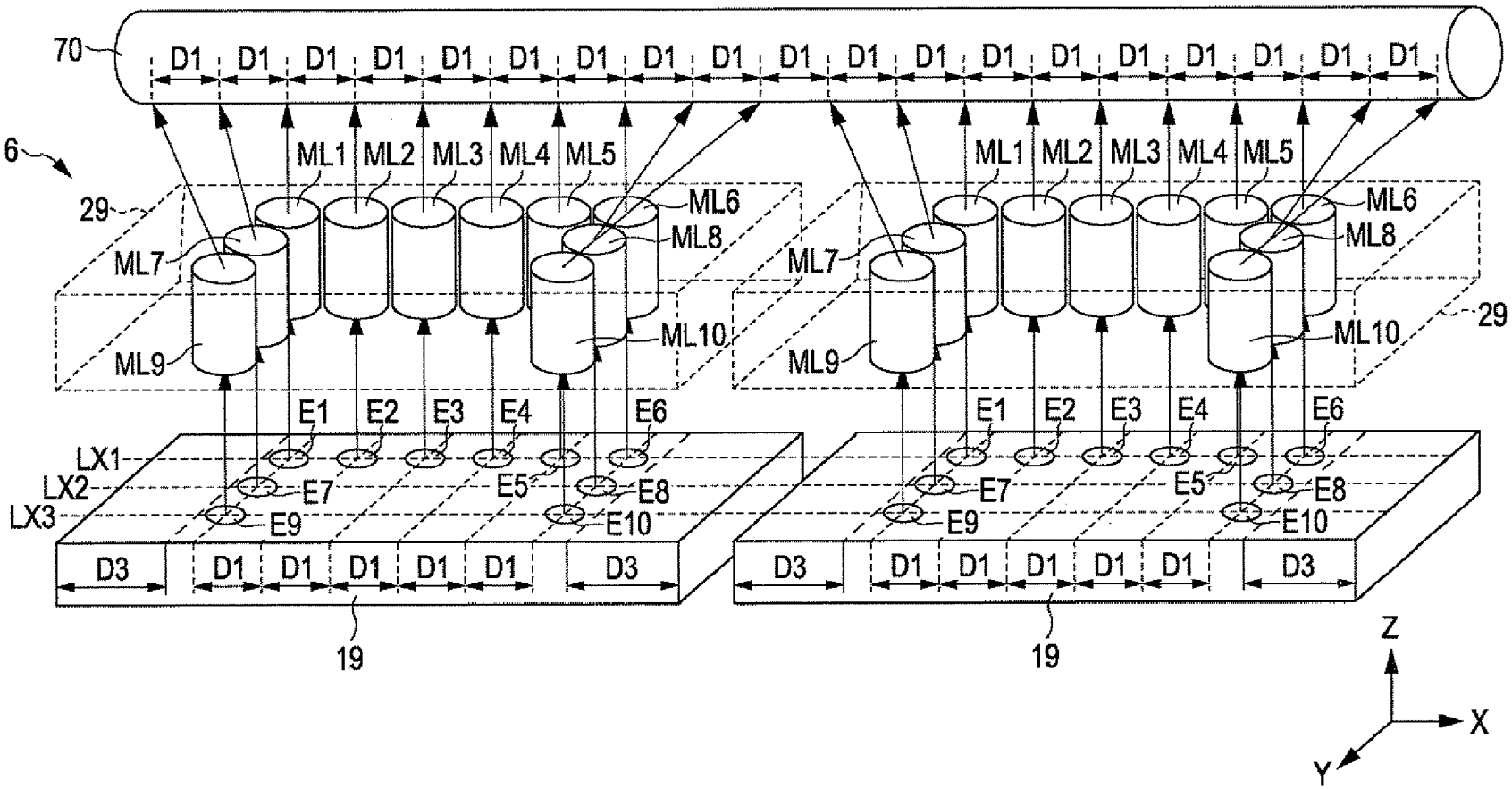
FIG. 18 is a perspective view illustrating a structure of an optical head according to Modified Example 5.

FIG. 18 is a perspective view illustrating a structure of an optical head 6 according to Modified Example 5.

In each light emitting element chip 19, in addition to the eight light emitting elements E1 to E8 described in the first embodiment, the light emitting elements E9 and E10 are disposed on the positions which are separated by a predetermined distance in the Y direction from the light emitting elements E7 and E8. Furthermore, in FIG. 18, the space between the straight line LX1 and the straight line LX2 may be not equal to the space between the straight line LX2 and the straight line LX3. In each lens array unit 29, in addition to the eight micro lenses ML1 to ML8 described in the first embodiment, the micro lens ML9 is provided at the position opposed to the light emitting element E9, and the micro lens ML10 is provided at the position opposed to the light emitting element E10. The micro lenses ML9 and ML10 are eccentric lenses. The degree of eccentricity of the micro lens ML9 is set such that that the image of the light, which is emitted from the light emitting element E9, can be formed on the side opposite to the X direction from the imaging position of the light, which is emitted from the light emitting element E7, by the pitch D1. Further, the degree of eccentricity of the micro lens ML10 is set such that that the image of the light, which is emitted from the light emitting element E10, can be formed on the X-direction side from the imaging position of the light, which is emitted from the light emitting element E8, by the pitch D1. Furthermore, it is preferable that the micro lens ML9 should be able to refract the light, which is emitted from the light emitting element E9, at least in the direction opposite to the X direction. However, the micro lens ML9 may also refract the light, which is emitted from the light emitting element E9, in the direction opposite to the Y direction. Likewise, it is preferable that the micro lens ML10 should be able to refract the light, which is emitted from the light emitting element E10, at least in the X direction. However, the micro lens ML10 may also refract the light, which is emitted from the light emitting element E10, in the direction opposite to the Y direction.

With such a configuration, it is possible to form, in a line, the images of the light, which is emitted from the four light emitting elements E7 to E10, on the outer sides from the imaging positions of the light, which is emitted from the light emitting elements E1 and E6, with the pitch D1 maintained. Further, it is possible to set the width D3 of the frame portion, by which the light emitting element chips 19 are lined up in a line, to a maximum of 2.5 times the pitch D1. Furthermore, three or more light emitting elements E may be lined up from each of both ends of the light emitting elements E1 to E6 in the Y direction. It is apparent that, when the number of the light emitting elements E lined up in the Y direction is increased as described above, it is also necessary to increase the number of the micro lenses ML (the eccentric lenses). Further, it is necessary to form the image of the light, which is emitted from each light emitting element E lined up in the Y direction, with the pitch D1 maintained by adjusting the degree of eccentricity of each micro lens ML.

The above description is similarly applied to the second embodiment. However, in the case of the second embodiment, the micro lenses ML7 to ML10 in FIG. 18 are not formed as eccentric lenses, and are formed as the lenses of which the optical centers and the geometric centers coincide with each other. Accordingly, it is necessary to adjust the shift lengths between the light emission centers of the light emitting elements E7 to E10 and the optical axes of the micro lenses ML7 to ML10. That is, in the case of the configuration shown in FIG. 18, the micro lens ML7, the light emitting element E7, the micro lens ML8, and the light emitting element E8 have the same configuration of the micro lens ML17, the light emitting element E7, the micro lens ML18, and the light emitting element E8 of the second embodiment, and thus a detailed description thereof will be omitted. However, the micro lens ML9 is disposed with the optical axis of the lens shifted at least in the direction opposite to the X direction from the light emission center of the light emitting element E9 such that the image of the light, which is emitted from the light emitting element E9, can be formed on the side opposite to the X direction from the imaging position of the light, which is emitted from the light emitting element E7, by the pitch D1. Further, the micro lens ML10 is disposed with the optical axis of the lens shifted at least in the X direction from the light emission center of the light emitting element E10 such that the image of the light, which is emitted from the light emitting element E10, can be formed on the X-direction side from the imaging position of the light, which is emitted from the light emitting element E8, by the pitch D1.

Figure 19:
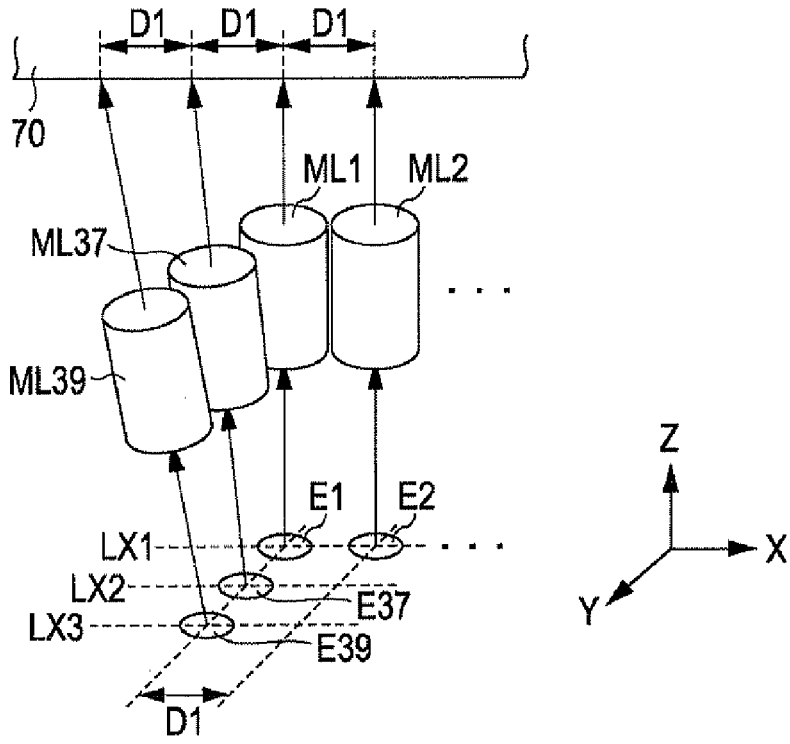
FIG. 19 is a perspective view illustrating Modified Example of the optical head according to the fourth embodiment.

Further, also in the case of the fourth embodiment, although only the configuration on one side (the light emitting element E1) is shown in FIG. 19, two or more light emitting elements E are disposed to be separated from each of both ends of the light emitting elements E1 to E6 in the Y direction, and the micro lenses ML corresponding thereto are provided. With such a configuration, by adjusting the direction of the light emitted from the light emitting element E and the slope of the optical axis of the micro lens ML, it is possible to form, in a line, the images of the light, which is emitted from four or more light emitting elements E, on the outer sides from the imaging positions of the light, which is emitted from the light emitting elements E1 and E6, with the pitch D1 maintained. Furthermore, in FIG. 19, the direction of the light, which is emitted from the light emitting element E39, and the slope of the optical axis of the micro lens ML39 is set such that the image of the light, which is emitted from the light emitting element E39, can be formed on the side opposite to the X direction from the imaging position of the light, which is emitted from the light emitting element E37, by the pitch D1.

Modified Example 6

Figure 20:
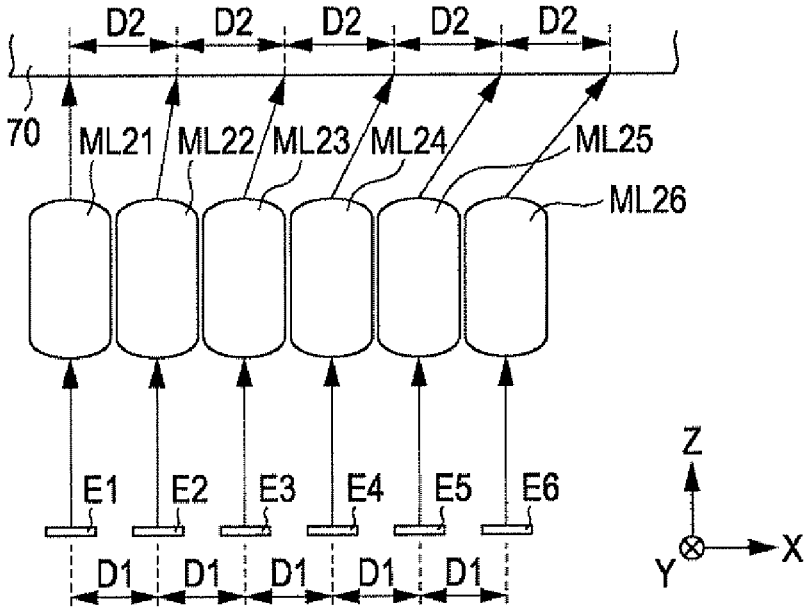
FIG. 20 is a plan view illustrating Modified Example of the optical head according to the third embodiment.
Figure 21:
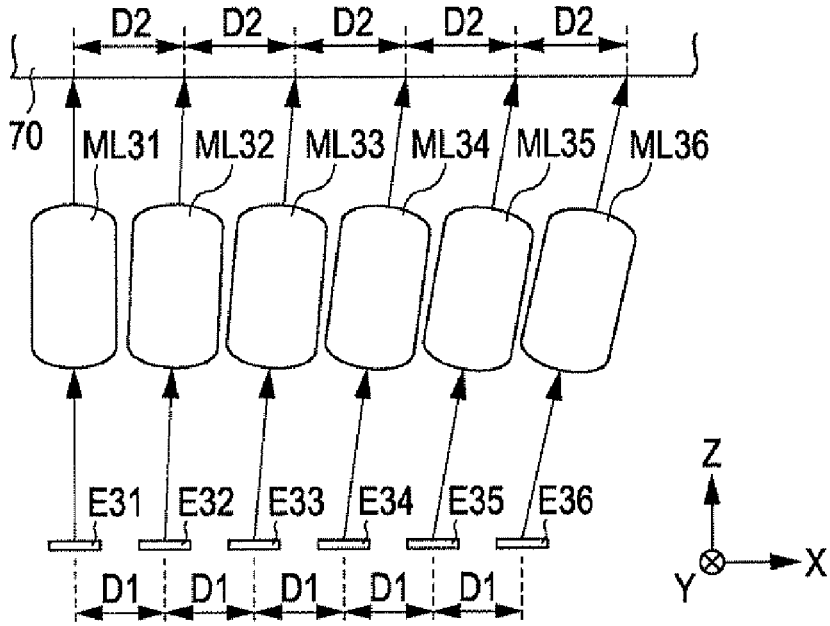
FIG. 21 is a plan view illustrating Modified Example of the optical head according to the fifth embodiment.

FIG. 20 is a plan view illustrating Modified Example of the optical head 3 according to the third embodiment. As shown in the drawing, among the six micro lenses ML21 to ML26 provided in one lens array unit 26, the remaining five micro lenses ML22 to ML26 except the micro lens ML21 may be configured to refract the light, which is emitted from the light emitting elements E opposed thereto, in the X direction. It is apparent that, contrary to the case of FIG. 20, the remaining five micro lenses ML21 to ML25 except the micro lens ML26 may be configured to refract the light, which is emitted from the light emitting elements E opposed thereto, in the direction opposite to the X direction. With such a configuration, it is also possible to form the images of the light, which is emitted from one or more light emitting elements E, on the portion on the surface of the photoconductor drum 70 corresponding to the frame portion of the light emitting element chip 16. Likewise, also in the fifth embodiment, for example as shown in FIG. 21, the directions of the light, which is emitted from the remaining five light emitting elements E32 to E36 except the light emitting element E31 among the six light emitting elements E31 to E36 provided in one light emitting element chip 18, may be configured to be tilted in the X direction with respect to the Z axis. In addition, the optical axes of the remaining five micro lenses ML32 to ML36 except the micro lens ML31 among the six micro lenses ML31 to ML36 provided in one lens array unit 28 may be configured to be tilted in the X direction with respect to the Z axis.

Modified Example 7

The micro lenses ML37 and ML38 of the fourth embodiment may be eccentric lenses. In this case, the micro lens ML37 is able to refract the light, which is emitted from the light emitting element E37, in the direction opposite to the X direction. Further, the micro lens ML38 is able to refract the light, which is emitted from the light emitting element E38, in the X direction. Accordingly, the directions of the light emitted from the light emitting elements E37 and E38 are not heavily tilted with respect to the Z direction. Likewise, the eccentric lenses may also be used in the micro lenses ML31 to ML36 of the fifth embodiment. Furthermore, in the fourth embodiment, by shifting the light emission center of the light emitting element E37 in the X direction from the position to which the optical axis of the micro lens ML37 extends, it is possible to refract the light, which is emitted from the light emitting element E37, in the direction opposite to the X direction through the micro lens ML37. Further, by shifting the light emission center of the light emitting element E38 in the direction opposite to the X direction from the position to which the optical axis of the micro lens ML38 extends, it is possible to refract the light, which is emitted from the light emitting element E38, in the X direction through the micro lens ML38. This is the same in the fifth embodiment.

Modified Example 8

In the first embodiment, in the lens array 20, the base may not be divided for each lens array unit 22. That is, the lens array 20 has one base provided at the position opposed to the plurality of light emitting element chips 12. The eight micro lenses ML may be provided in each area opposed to the each of the plurality of light emitting element chips 12 in the base. Further, the lens array 20 may be configured such that the gap other than the portions where the micro lenses ML are arranged is filled with a resin having a light blocking effect. The above description is similarly applied to the second to fifth embodiments.

Modified Example 9

Figure 22:
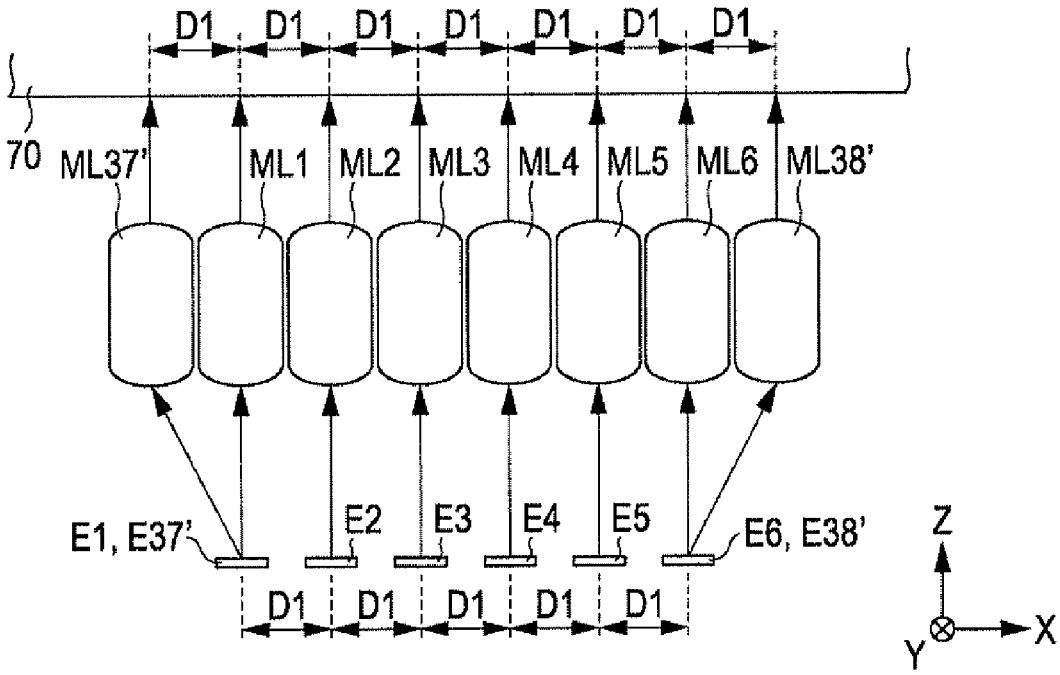
FIG. 22 is a plan view illustrating Modified Example of the optical head according to the fourth embodiment.

When the lens array 20 is formed of a single base as described in Modified Example 8, the optical head 4 according to the fourth embodiment may be modified as shown in FIG. 22. Further, FIG. 22 shows eight light emitting elements E1 to E6, E37', and E38' provided in one light emitting element chip 17 and eight micro lenses ML1 to ML6, ML37', and ML38' corresponding thereto. There is a difference from the configuration, which is described in the fourth embodiment, in the positions of the micro lenses ML37' and ML38', the slopes of the optical axes thereof, and the directions of the light emitted from the light emitting elements E37' and E38'. The micro lenses ML37' and ML38' are provided in the positions which are separated by the predetermined distance in the Y direction relative to the array of the micro lenses ML1 to ML6. However, the micro lens ML37' is disposed to be separated from the array position of the micro lens ML1 by the pitch D1 in the direction opposite to the X direction. In addition, the micro lens ML38' is disposed to be separated from the array position of the micro lens ML6 by the pitch D1 in the X direction. Further, the optical axes of all the micro lenses ML37' and ML38' are disposed to be in the Z direction. As described above, the positions of the micro lenses ML37' and ML38' and the slopes of the optical axes thereof are different. Therefore, the direction of the light which is emitted from each of the light emitting elements E37' and E38' has a slope larger than the direction of the light, which is emitted from each of the light emitting elements E37 and E38 described in the fourth embodiment, with respect to the Z axis. With such a configuration, it is also possible to form the images of the light, which is emitted from the light emitting elements E37' and E38', on the outer sides from the imaging positions of the light, which is emitted from the light emitting elements E1 and E6, with the pitch D1 maintained.

Figure 23:
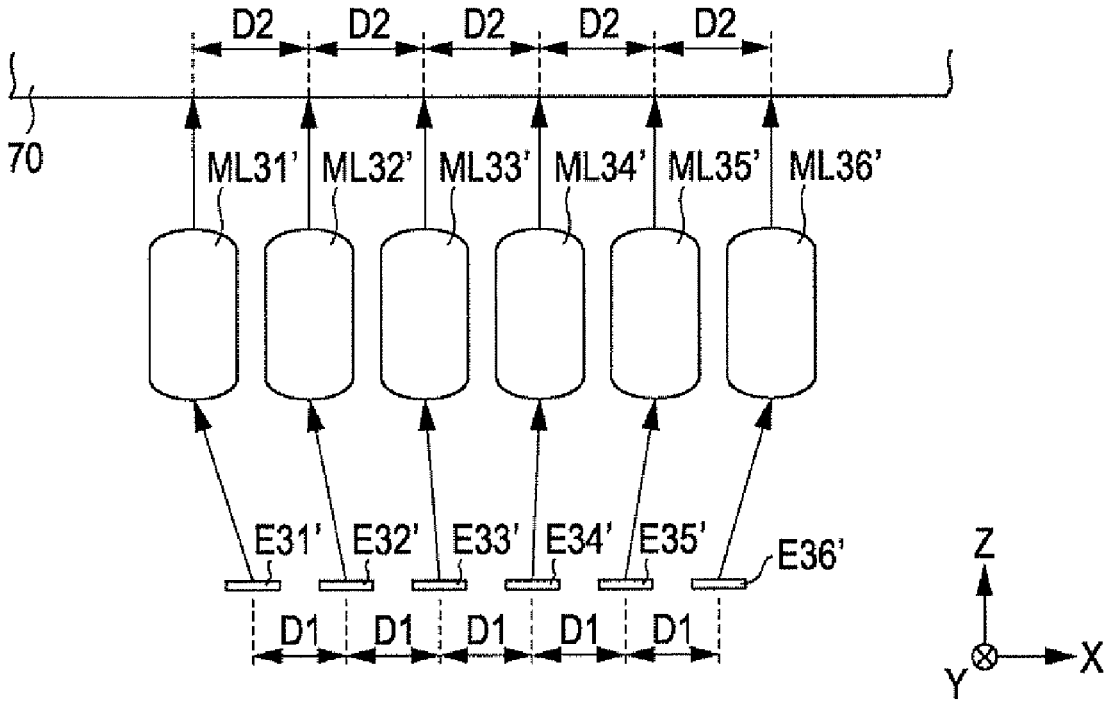
FIG. 23 is a plan view illustrating Modified Example of the optical head according to the fifth embodiment.

Further, when the lens array 20 is formed of a single base, the optical head 5 according to the fifth embodiment may be modified as shown in FIG. 23. Further, FIG. 23 shows six light emitting elements E31' to E36' provided in one light emitting element chip 18 and six micro lenses ML31' to ML36' corresponding thereto. There is a difference from the configuration, which is described in the fifth embodiment, in the positions of the micro lenses ML31' to ML36', the slopes of the optical axes thereof, and the directions of the light emitted from the light emitting elements E31' to E36'. The six micro lenses ML31' to ML36' are arranged in a line at the pitch D2 along the X direction. Further, the optical axes of all the micro lenses ML31' to ML36' are disposed to be in the Z direction. As described above, the positions of the micro lenses ML31' to ML36' and the slopes of the optical axes thereof are different. Therefore, the direction of the light which is emitted from each of the light emitting elements E31' to E36' has a slope larger than the direction of the light, which is emitted from each of the light emitting elements E31 to E36 described in the fifth embodiment, with respect to the Z axis. With such a configuration, it is also possible to form the images of the light, which is emitted from the light emitting elements E31' and E36', on the outer side from the positions, which correspond to the light emitting elements E31' and E36', on the surface of the photoconductor drum 70 with the pitch D2 maintained.

Modified Example 10

In the fourth embodiment, the first electrodes 56 and 56*a* are used as anodes, and the second electrodes 59 and 59*a* are used as cathodes, but the reverse thereof may be allowed. This is the same in the fifth embodiment. Further, the light emitting elements E31 to E36 in the fifth embodiment is not limited to the structure exemplified in FIG. 16 or 17, and may have, for example, the structure shown in FIG. 13 or 14.

Modified Example 11

In the first embodiment, in the micro lenses ML1 to ML6 and the micro lenses ML7 and ML8, the radii of curvature of lens portions may be equal to one another, and may be different from one another. Further, when the radii of curvature of the lens portions of the micro lenses ML7 and ML8 are set to be large, it is possible to heavily refract the light, which is emitted from the light emitting elements E7 and E8 opposed thereto. This is the same in the second embodiment.

Furthermore, in the third embodiment, in the micro lenses ML21 to ML26, the radii of curvature of lens portions may be equal to one another, and may be different from one another. Further, as the radii of curvature of the lens portions are larger, it is possible to more heavily refract the light, which is emitted from the light emitting elements E opposed thereto. Accordingly, in each lens array unit 26, it is preferable that, as the array position of the micro lens ML becomes closer to each end from the center (ML23→ML22→ML21 and ML24→ML25→ML26), the radii of curvature of the lens portions should be set to be larger.

Modified Example 12

In the micro lenses ML17 and ML18 of the second embodiment, the radius of curvature of each incident-side lens portion may be different from that of each exit-side lens portion. For example, the radius of curvature of the exit-side lens portion may be set to smaller than the radius of curvature of the incident-side lens portion. This is the same in the case of using the lens of which the optical center and the geometric center coincide with each other in the third embodiment.

Modified Example 13

The light emitting element E is not limited to an organic light-emitting diode element, and may be an LED element, an inorganic EL element, a plasma display element, or the like. Further, the light emitting element E may be a voltage-driving element which is driven by applying a voltage. Further, when the light emitting face of the light emitting element E has a shape other than a circular shape, it is preferable to make the center thereof coincide with the light emission center of the light emitting element E. Further, the pitch D1 or the pitch D2 may not be constant (equidistant). Further, the light emission panel 10 may not be a top emission type, but may be a bottom emission type.

Modified Example 14

For example, as described in FIG. 8 of JP-A-2008-93882, the plurality of light emitting elements E are provided at the position opposed to one micro lens ML, and one light emitting portion may be constituted of the plurality of light emitting elements E. In this case, it is preferable to make the center (the weighted center) of the plurality of light emitting elements E constituting the one light emitting portion coincide with the light emission center of the light emitting portion.

G. Electronic Device

Next, a description will be given of a specific example of an electronic device using the optical heads according to the above-mentioned embodiments and Modified Examples.

Figure 24:
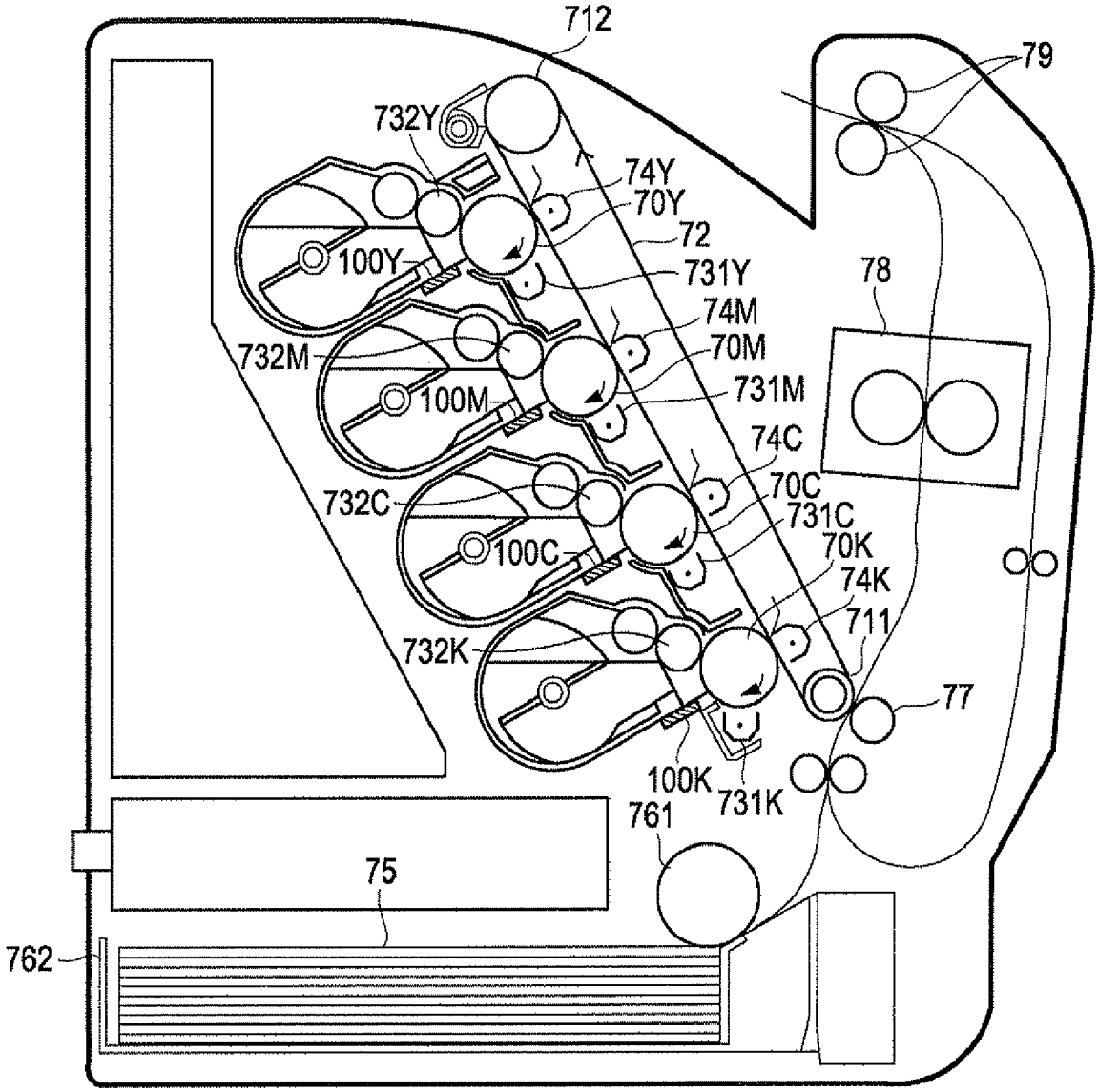
FIG. 24 is a sectional view illustrating a specific example (an image forming apparatus) of an electronic device.

FIG. 24 is a sectional view illustrating a configuration of an image forming apparatus.

The image forming apparatus is a tandem type full-color image forming apparatus, and employs the optical head according to the above-mentioned embodiments and Modified Examples as an exposure device. The image forming apparatus includes four optical heads 100 (100K, 100C, 100M, and 100Y) and four photoconductor drums 70 (70K, 70C, 70M and 70Y) corresponding to the respective optical heads 100. One optical head 100 is disposed to face the outer circumferential surface of the photoconductor drum 70 corresponding to the optical head 100. Furthermore, additional characters "K", "C", "M" and "Y" of the reference numerals indicate members which are used in forming an actual images of black (K), cyan (C), magenta (M) and yellow (Y).

An endless intermediate transfer belt 72 is wound around a driving roller 711 and a driven roller 712. The four photoconductor drums 70 are disposed in the vicinity of the intermediate transfer belt 72 with a predetermined interval interposed therebetween. Each photoconductor drum 70 rotates in synchronization with a drive of the endless intermediate transfer belt 72. Around the photoconductor drums 70, in addition to the optical head 100, a corona electrifier 731 (731K, 731C, 731M, and 731Y) and a developing unit 732 (732K, 732C, 732M, and 732Y) are arranged. The corona electrifier 731 uniformly electrically charges the outer circumferential surface of the photoconductor drum 70 corresponding thereto. Each optical head 100 exposes the charged outer circumferential surface, thereby forming an electrostatic latent image. Each developing unit 732 adheres a developing material (a toner) to the electrostatic latent image, so that an actual image (a visible image) is formed on the photoconductor drum 70.

As described above, each color actual image (black, cyan, magenta, and yellow) formed on the photoconductor drum 70 is transferred (first transfer) sequentially to the surface of the intermediate transfer belt 72, thereby forming a full color actual image. Four first transfer corotrons (transfer units) 74 (74K, 74C, 74M, and 74Y) are arranged inside the intermediate transfer belt 72. Each first transfer corotron 74 electrostatically attracts the actual image from the photoconductor drum 70 corresponding thereto, thereby transferring the actual image to the intermediate transfer belt 72 passing through the gap between the photoconductor drum 70 and the first transfer corotron 74.

Sheets (a printing medium) 75 are fed one by one from a sheet feeding cassette 762 by a pickup roller 761, and transported to a nip between the intermediate transfer belt 72 and a second transfer roller 77. The full color actual image formed on the intermediate transfer belt 72 is transferred (second transfer) to one side of the sheet 75 by a second transfer roller 77, and is passed through a pair of fixing rollers 78 to be fixed on the sheet 75. A pair of sheet ejection rollers 79 ejects the sheet 75 on which the actual image is fixed after the above processes.

Since the image forming apparatus uses an organic light-emitting diode element as a light source, the apparatus can be miniaturized compared with a configuration which uses a laser scanning optical system. The optical head 100 can be applied to a rotary developing type image forming apparatus, an image forming apparatus which directly transfers an actual image from the photoconductor drum 70 to the sheet without using the intermediate transfer belt, or an image forming apparatus which forms a monochromatic image.

Further, the application of the optical head 100 is not limited to the exposure of the image carrier. For example, the optical head 100 is employed in an image reading apparatus as an illumination apparatus for emitting light to a readout target such as an original document. Examples of such an image reading apparatus include a scanner, a copier, a reading section of a copy machine and a facsimile, a barcode reader, and a two-dimensional image code reader for a two-dimensional image code such as a QR code (registered trademark).

The entire disclosure of Japanese Patent Application No. 2010-086760 filed Apr. 5, 2010 is expressly incorporated by reference herein.

What is claimed is:

1. An optical head comprising:

a light emitting substrate that has a plurality of first light emitting portions arranged in a main scanning direction and a second light emitting portion disposed in a direction intersecting the main scanning direction with respect to the array of the plurality of first light emitting portions; and a lens array that has a plurality of first lenses, each of which is provided at a position facing each of the plurality of first light emitting portions and forms an image of light emitted from each first light emitting portion on an illumination target surface, and a second lens which forms an image of light emitted from the second light emitting portion on the illumination target surface, wherein the image of the light, which is emitted from each of the plurality of first light emitting portions, is formed at a position where the illumination target surface intersects with a straight line which connects each corresponding first light emitting portion to each first lens facing thereto, wherein a direction of the emitted light from the second light emitting portion has a slope with respect to a straight line which extends perpendicularly from a light emitting face of the corresponding second light emitting portion, and wherein when an imaging position of the light emitted from the first light emitting portion located at one end among the plurality of first light emitting portions is set as a first imaging position and an imaging position of the light emitted from another first light emitting portion is set as a second imaging position, the image of the light emitted from the second light emitting portion is formed on a side opposite to a side of the second imaging position with the first imaging position interposed therebetween.

2. The optical head according to claim 1, wherein the second light emitting portion has a light emitting layer that emits light, and a light reflecting layer that reflects the light which is emitted by the light emitting layer, and wherein the light reflecting layer is formed such that a direction of the reflected light has the slope.

3. The optical head according to claim 2, wherein the light reflecting layer is disposed at a predetermined angle to the light emitting layer such that the direction of the reflected light has the slope.

4. An electronic device comprising the optical head according to claim 3.

5. The optical head according to claim 2, wherein the light reflecting layer has a prescribed shape such that the direction of the reflected light has the slope.

6. An electronic device comprising the optical head according to claim 5.

7. An electronic device comprising the optical head according to claim 2.

8. The optical head according to claim 1, wherein the plurality of first light emitting portions is arranged at a predetermined pitch in the main scanning direction, and wherein the image of the light emitted from the second light emitting portion is formed at a position which is separated by the predetermined pitch in a direction opposite to the side of the second imaging position from the first imaging position.

9. An electronic device comprising the optical head according to claim 8.

10. The optical head according to claim 1, wherein the number of the second light emitting portions, which are provided in the light emitting substrate, is two, wherein the number of the second lenses, which are provided in the lens array so as to form the images of the light emitted from the corresponding second light emitting portions, is two, wherein the direction of the emitted light from each of the two second light emitting portions has a slope with respect to the straight line which extends perpendicularly from the light emitting face of the corresponding second light emitting portion, wherein the image of the light emitted from one of the second light emitting portions is formed on the side opposite to the side of the second imaging position with the first imaging position interposed therebetween, and wherein when an imaging position of the light emitted from the first light emitting portion located at the other end among the plurality of first light emitting portions is set as a third imaging position and an imaging position of the light emitted from another first light emitting portion is set as a fourth imaging position, the image of the light emitted from the other of the second light emitting portions is formed on a side opposite to a side of the fourth imaging position with the third imaging position interposed therebetween.

11. An electronic device comprising the optical head according to claim 10.

12. The optical head according to claim 1, wherein a plurality of the light emitting substrates and a plurality of the lens arrays are provided, and the plurality of the light emitting substrates and the plurality of the lens arrays are arranged in the main scanning direction.

13. An electronic device comprising the optical head according to claim 1.

14. An optical head comprising:

a light emitting substrate that has a plurality of first light emitting portions arranged in a main scanning direction and a second light emitting portion disposed in a direction intersecting the main scanning direction with respect to the array of the plurality of first light emitting portions; and a lens array that has a plurality of first lenses, each of which is provided at a position facing each of the plurality of first light emitting portions and forms an image of light emitted from each first light emitting portion on an illumination target surface, and a second lens which forms an image of light emitted from the second light emitting portion on the illumination target surface, wherein a direction of the emitted light from each of the plurality of first light emitting portions coincides with a straight line which extends perpendicularly from a light emitting face of the corresponding first light emitting portion, and wherein a direction of the emitted light from the second light emitting portion has a slope with respect to a straight line which extends perpendicularly from a light emitting face of the corresponding second light emitting portion.

* * * * *